United States Patent [19]

Miyata et al.

[11] 4,372,676

[45] Feb. 8, 1983

[54] ELECTROPHOTOGRAPHIC COPYING MACHINE

[75] Inventors: Shin Miyata; Tateomi Kono, both of Toyokawa; Kenji Shibazaki, Aichi; Yoichi Utsunomiya, Tondabayashi, all of Japan

[73] Assignee: Minolta Camera Co., Ltd., Higashi Osaka, Japan

[21] Appl. No.: 243,715

[22] Filed: Mar. 16, 1981

[30] Foreign Application Priority Data

Mar. 19, 1980 [JP] Japan ..... 55/35450

[51] Int. Cl.[3] ..... G03G 15/00

[52] U.S. Cl. ..... 355/14 C; 355/55; 355/14 R

[58] Field of Search ..... 355/14 C, 14 R, 8, 55-57, 355/3 R

[56] References Cited

U.S. PATENT DOCUMENTS

| | | | |
|---|---|---|---|
| 4,214,833 | 7/1980 | Kono | 355/14 C |
| 4,260,248 | 4/1981 | Murata et al. | 355/14 C |
| 4,269,500 | 5/1981 | Ito et al. | 355/14 C |
| 4,314,754 | 2/1982 | Shimizu et al. | 355/14 C |

*Primary Examiner*—Richard L. Moses

*Attorney, Agent, or Firm*—Jackson, Jones & Price

[57] ABSTRACT

An electrophotographic copying machine of a transfer type has a capability of reproducing an image on a copying paper selectively at a plurality of magnifications and also a capability of feeding copying papers of different sizes. The machine comprises a plurality of timers of a first group operable in common to all of modes of operation of the machine and a plurality of timers of a second group operable during a particular mode of operation, these timers of the first and second groups being sequentially controlled by a microcomputer.

28 Claims, 36 Drawing Figures

| Paper | Paper Size (mm) | | magnets | | | |
|---|---|---|---|---|---|---|
| | Length | Width | mA | mB | mC | mD |
| A3 | 420 | 297 | ○ | | | |
| B4 | 364 | 257 | | ○ | | |
| A4 | 210 | 297 | ○ | | | ○ |
| A4 | 297 | 210 | ○ | | ○ | |
| B5 | 182 | 257 | ○ | | ○ | ○ |
| B5 | 257 | 182 | | | | ○ |
| A5 | 210 | 148.5 | | | ○ | ○ |
| B6 | 182 | 129 | | ○ | ○ | ○ |
| A6 | 148.5 | 105 | ○ | ○ | ○ | ○ |

ELECTROPHOTOGRAPHIC COPYING MACHINE

BACKGROUND OF THE INVENTION

The present invention generally relates to a copying machine and, more particularly, to an electrophotographic copying machine of slit exposure type having a plurality of sequence modes of operation.

With recent advancement in integrated circuit technology, low-cost and versatile micro-computers have largely been developed and some of them are currently employed in machines for use in promotion of the public welfare. This trend applies even in the field of copying machine and, in reality, a diversity of copying machines are currently available and/or suggested.

Of the copying machines now available in the commercial market, a copying machine utilizing a micro-computer, especially a computerized electrophotographic copying machine of either slit exposure type or powder image transfer type which had generally been considered complicated in sequence of control, has now been developed to such an extent that a variety of functions can automatically be controlled accurately and efficiently in sequence. This type of computerized, or computer-controlled, copying machine involves numerous advantages.

On the other hand, diversification of the available functions has posed numerous problems. In other words, the programmed sequence control performed by a micro-computer is the sequence control wherein desired control signals are generated when counted values of clock pulses which are generated in the micro-computer and which have been counted and/or divided to attain programmed numerical data each determined for a particular control objective, the programmed numerical data being, however, correlated to each other as a whole so that the control objectives can be controlled in a predetermined sequence. In view of this, where the sequence control by the digital timer is desired to be performed in exact and accurate unison with operation of the machine with respect to the whole control objectives, not only are timers of different preset times one for each of the control objectives required, but also the number thereof is many.

In an electrophotographic copying machine, where it is desired to have a number of functional capabilities of, for example, reproducing an image in one of a plurality of magnifications and on a copying paper of a size selected from a plurality of sizes of papers with which the machine can work, and yet, where those functional capabilities are required to be controlled in sequence, not only is the available combination thereof many, but also a corresponding number of timers are required. In addition thereto, a difficulty is involved in carrying out a check as to whether or not the sequence control being performed ensures an exact and correct operation of the copying machine. Especially, where repeated reproduction of the same image on two or more copying papers is to be carried out, this should not be a mere repetition of the sequence that is performed during the reproduction of an image on one copying paper and, in order to increase the copying speed, measures must be taken to enable the machine to be ready for the next succeeding reproduction of the image half-way during the sequence for the preceding reproduction of the image being currently performed. Heretofore, in order for the next succeeding copying operation, specifically the scanning of the image to be reproduced, to be initiated during the repeated copying operation of the machine, a complete return of the optical scanner to the original position after having been moved to the opposite, scanned position has generally been required and so is evidenced by the fact that a timing signal generated upon the complete return of the optical scanner to the original position has long been utilized.

However, with the diversification of the sequence modes, it has been found the timing at which the optical scanner returns to the original position is too early to provide a starting point at which the next succeeding copying operation is initiated in view of the position of a copying paper being supplied and also the operation of a paper jamming detector. In order to eliminate this inconvenience, it may be possible to use a timer of a preset time long enough to provide a delay before the start of the next succeeding copying operation so that the machine can be programmed so as to initiate the next succeeding copying operation after the lapse of the preset time of the timer. However, where the timer of the type referred to above is actually employed, the stand-by time during which the machine is held standstill is unnecessarily prolonged, resulting in a relatively large loss of time and also hampering the high speed operation of the copying machine.

Although the use of a timer for multi-copying for each sequence mode can be contemplated to eliminate the above described disadvantages, this in turn results in the increased number of timers employed. Yet, in the case where the timer for multi-copying is set at the mode at which the next succeeding copying operation can be initiated immediately after the complete return of the optical scanner to the original position, it is in practice difficult to coincide the timing at which the timing signal is to be generated from the timer with the timing at which the optical scanner completes its return movement to the original position. Even in this case, the timer must have a sufficiently long preset time and a loss of time is involved accordingly.

SUMMARY OF THE INVENTION

The present invention has been developed with a view to substantially eliminating the above described disadvantages and inconveniences and has for its essential object to provide an improved electrophotographic copying machine having a plurality of sequence modes of operation wherein a plurality of timers are employed so as to operate in timmed relation to each other to enable an efficient continued copying operation of the machine.

Another object of the present invention is to provide an improved electrophotographic copying machine of the type referred to above, which is reliable in performance and employs a minimized number of component parts.

The present invention is directed to an electrophotographic copying machine of transfer type which comprises an electrophotographic member supported for rotation in one direction, a support for the support of an original to be copied thereon, a scanning means supported for reciprocal movement between start and scanned positions relative to the original support to scan the original on the support, means for designating one of a plurality of image forming conditions for determing a particular mode of operation, means for driving the scanning means, means for detecting that the scanning means is held at the start position, means for transporting a copying paper, and control means operatively correlated with at least said scanning means, said designating means, said driving means, said detecting means and said transferring means for generating a control signal during the mode of operation based on the image forming condition designated by the designating means.

The objects of the present invention discussed above can be accomplished by providing the electrophotographic copying machine of the above described construction with a first group of timer means utilizable in common to all of the modes irrespective of said particular mode of operation, means for determining the particular mode of operation on the basis of an output signal generated from the designating means, a second group of timer means having their preset times determined in correspondence to the mode of operation determined by the determining means, and a processing means for generating, in response to the lapse of the preset time of each timer means of the first and second groups, a control signal necessary to control said scanning means, said driving means and said transferring means and also for performing a process incident to completion of one copying operation when both of the condition in which the preset time of one particular timer means of the second group has been passed and the condition in which the detecting means has detected the complete return of the scanning means to the start position after having been moved to the scanned position are fulfilled.

By constructing the electrophotographic copying machine in the manner described above, not only can the copying operation be carried out efficiently, but also a plurality of copies can be made in rapid repetitive succession.

BRIEF DESCRIPTION OF THE DRAWINGS

These and other objects and features of the present invention will become apparent from the following description taken in conjunction with a preferred embodiment thereof shown in the accompanying drawings, in which:

FIG. 23(*b*) is a chart showing an arrangement of the magnets in relation to the sizes of copying papers;

DETAILED DESCRIPTION OF THE EMBODIMENT

Figure 1:
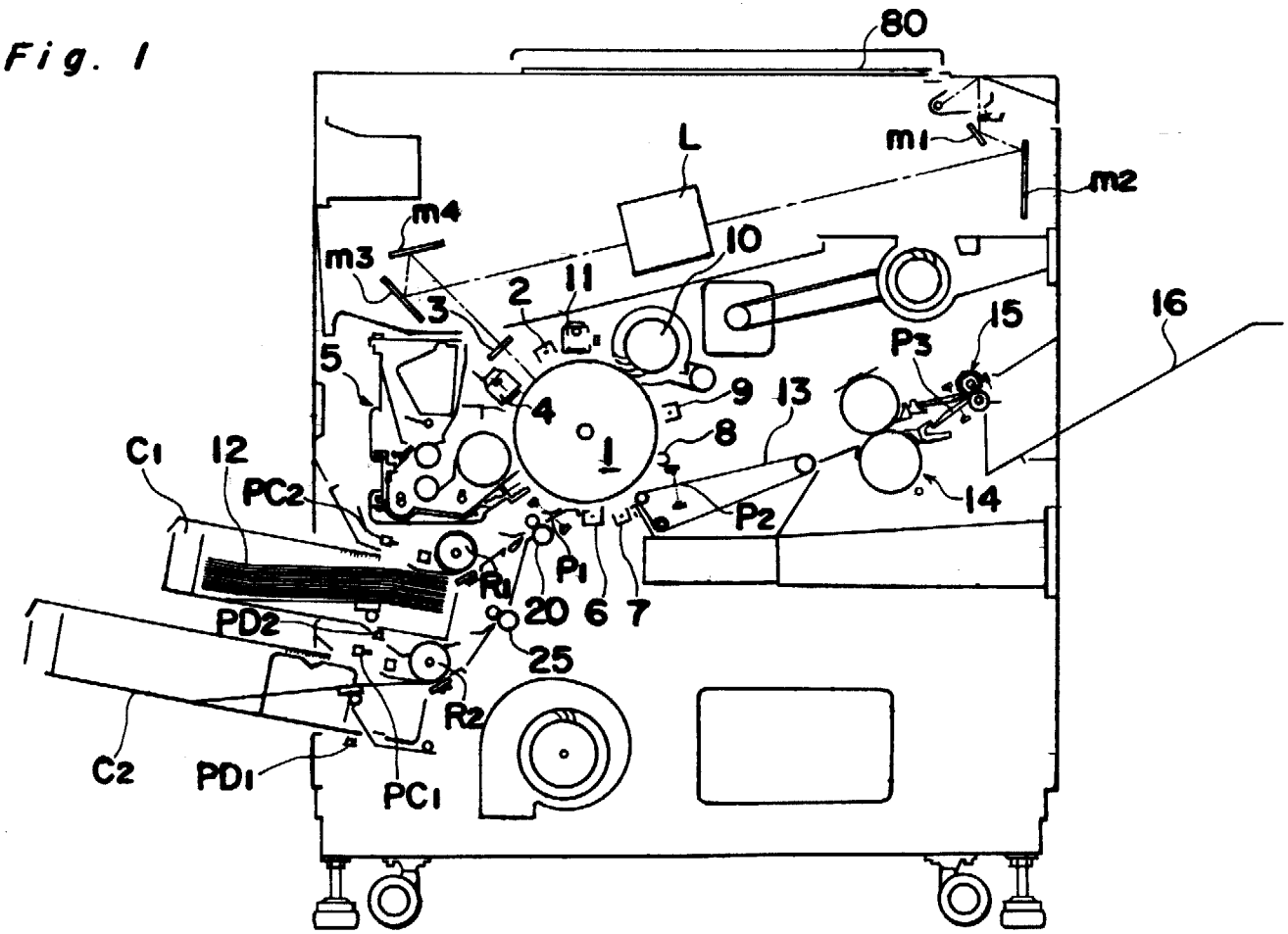
FIG. 1 is a schematic side view of an electrophotographic copying machine showing an arrangement of working components thereof.

Before the description of the present invention proceeds, it is to be noted that like parts are designated by like reference numerals throughout the accompanying drawings. It is also to be noted that, for facilitating an easy and better understanding of the present invention, the latter will be described under separate headings.

Copying Machine and Operation

Referring to FIG. 1, an electrophotographic copying machine to which the present invention is applied comprises an electrophotographic member which is shown in the form of a photoreceptor drum 1 made of metal such as aluminum and having its outer peripheral surface deposited, either by coating or by vapor deposition, with a photoconductive layer of, for example, selenium. This photoreceptor drum 1 is supported within the machine housing for rotation in one direction, for example, in a counterclockwise direction as viewed in FIG. 1, in any known manner.

Around the photoreceptor drum 1, there are arranged in a given order, an electrostatic charger 2, an exposure filter 3, a side eraser 4, a developing unit 5, a transfer charger 6, an AC eraser 7 for facilitating separation of a copying paper from the photoreceptor drum 1, an air nozzle assembly 8 for separating the copying paper from the photoreceptor drum 1, an AC eraser 9, a cleaning unit 10 and an eraser lamp 11, each of these components 2 to 11 being so arranged as to work on the photoreceptor drum 1 as it rotates in the counterclockwise direction.

The outer peripheral surface of the photoreceptor drum 1 after residual powder and residual electrostatic charge have already been removed in seccession by the cleaning unit 10 and the eraser lamp 11 is uniformly charged with an electrostatic charge by the charger 2 and is subsequently exposed through the filter 3 to an optical image of an original indicia to be reproduced, which original is scanned by an optical scanning system as will be described later. By this way, an electrostatic latent image complemental in shape to the image of the original can be formed on the photoreceptor drum 1.

The side eraser 4 is operable to dissipate an unwanted portion of electrostatic charge, deposited on an end portion of the photoreceptor drum, when the machine is set to operate so as to reproduce the original image on a copying paper on a reduced scale and, for this purpose, this side eraser 4 is operatively associated with a magnification selector.

The electrostatic latent image so formed on the photoreceptor drum 1 in the manner as described above is developed by the developing unit 5 into a visible powder image, which powder image is subsequently transferred onto the copying paper 12 which has been transported from a paper feed mechanism, as will be described later, in synchronism with the rotation of the photoreceptor drum 1. Shortly before the transfer of the powder image onto the copying paper 12, the latter is electrostatically charged by the transfer charger 6 so that the powder image can be attracted onto the copying paper as it contacts the photoreceptor drum 1 being rotated. The electrostatic attractive force developed between the copying paper 12 and the photoreceptor drum 1 during the transfer of the powder image onto the copying paper 12 is removed by the AC eraser 7 and, thereafter, the copying paper 12 bearing the transferred powder image is separated from the photoreceptor drum 1 by the aid of air jets blown off from the air nozzle asssembly 8. The copying paper 12 so separated from the photoreceptor drum 1 is then transported by a conveyance belt 13 towards a fixing device whereat the powder image on the copying paper 12 is fixed by the application of both heat and pressure. The copying paper having the powder image fixed thereon is finally ejected out of the machine housing and onto a storage tray 16 by means of an ejecting roller assembly 15.

During the continued rotation of the photoreceptor drum 1 and after the copying paper bearing the powder image has been separated from the photoreceptor drum 1 in the manner described above, the electrostatic charge is again erased by the AC eraser 9, followed by the cleaning of the photoreceptor drum 1 which is performed by the cleaning unit 10 to remove the residual powder. Thereafter and shortly before completion of one complete rotation of the photoreceptor drum 1, rays of light are radiated by the eraser lamp 11 onto the photoreceptor drum 1 to completely remove the residual electrostatic charge in readiness for the next succeeding reproduction.

While the details of the paper feed mechanism will be described later, the copying machine to which the present invention is applied has upper and lower paper supply units one positioned above the other, each of the paper supply units being adapted to receive a paper cassette containing copying papers in stacked state. The stacked copying papers 12 in the respective paper cassettes loaded in the paper supply units are held in contact with associated feed roller R1 and R2 which are selectively rotated one at a time to supply the copying papers 12 from the upper and lower cassettes C1 and C2. It is to be noted that, in FIG. 1, the upper cassette C1 is shown as containing the copying paper of small size whereas the lower cassette C1 though shown as empty is adapted to contain the copying papers of a size larger than that in the cassette C1.

Where each copying paper is supplied from the upper cassette C1, the copying paper so supplied is temporarily held standstill by a timing roller 20 which is driven in response to a synchronizing signal, necessary to synchronize the paper feed with the rotation of the photoreceptor drum 1, to feed the copying paper towards a transfer station whereby the powder image on the photoreceptor drum 1 is transferred onto such copying paper. On the other hand, where each copying paper is supplied from the lower cassette C2, the supply of the copying paper is initiated earlier than that from the upper cassette C1 and the copying paper so supplied is held standstill by an intermediate feed roller assembly 25. This intermediate roller assembly 25 is driven in response to the application of a suitable timing signal so as to feed the copying paper towards the timing roller 20 whereby the copying paper is again held stationary until the synchronizing signal is applied to a drive for the timing roller 20.

Hereinafter, the details of each of the operating mechanisms of the copying machine and the sequence of operation thereof will be described.

Paper Feed Mechanism:

As hereinbefore described, the copying machine to which the present invention is applied can be loaded with the two cassettes one above the other. However, since paper feed mechanisms one for each paper cassettes C1 and C2 are of identical construction, only one of them will be described in details for the sake of bravity.

Figure 2:
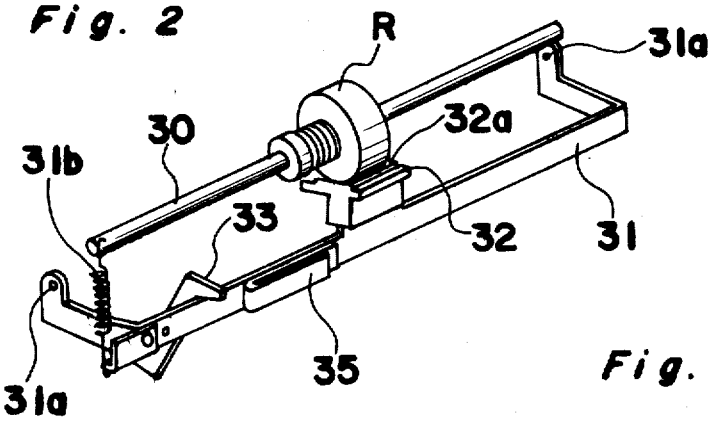
FIG. 2 is a perspective view of a paper feed roller assembly used in the machine.

Referring to FIG. 2 wherein the paper feed roller assembly is schematically shown, the feed roller R is rigidly mounted on a shaft 30 for rotation together therewith at a position substantially intermediate of the length of the shaft 30, which shaft 30 is adapted to receive a rotary drive necessary to rotate the roller R through a clutch unit of a construction as will be described later. A generally U-shaped lever 31 is supported at 31*a* for pivotal movement in a plane perpendicular to the shaft 30 and is normally biased counterclockwise as viewed in FIG. 2 by a spring 31*b*. The lever 31 has a dispatching stand 32 rigidly mounted thereon in alignment with the feed roller R and protruding therefrom towards the roller R. This dispatching stand 32 has a friction member 32*a* lined on one surface of the dispatch stand 32 facing the roller R1 which friction member 32*a* is normally held in contact with the roller R because of the lever 31 being biased counterclockwise by the spring 31*b*. The roller R is cooperable with the dispatching stand 32 in such a manner that the copying papers can be drawn out of the associated paper cassette one at a time in succession and then fed towards the processing station through a nipping area between the roller R and the friction member 32*a* during rotation of the roller R.

Figure 3B:
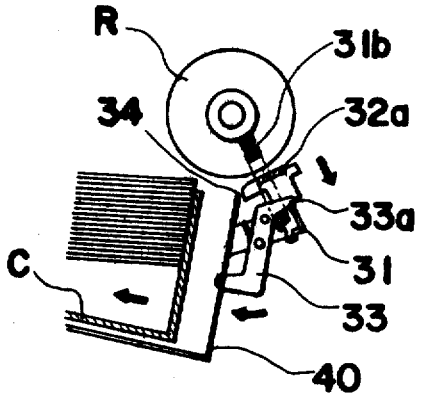
FIGS. 3(*a*) and 3(*b*) are side sectional views of the paper feed roller assembly shown in different operative positions, respectively.
Figure 3A:
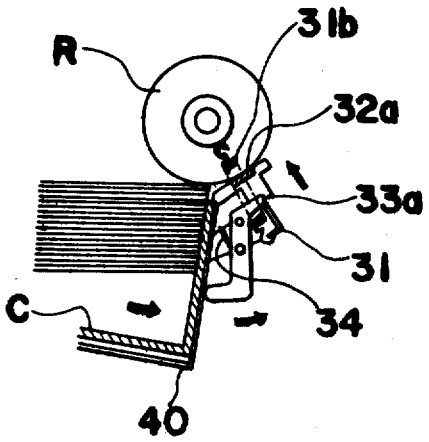

The lever 31 can be pivoted clockwise against the spring 31*b* to disengage the dispatching stand 32 from the roller R in response to the removal of the paper cassette C from an associated cassette holder 40. For this purpose, as best shown in FIGS. 3(*a*) and 3(*b*), a release mechanism is employed, which release mechanism comprises a release lever 33 supported at a substantially intermediate portion thereof for pivotal movement between engaged and disengaged positions and a torsion spring 34 for biasing the release lever 33 to assume the disengaged position as shown in FIG. 3(*b*), one end 33*a* of said release lever 33 being normally engaged to the lever 31. This release mechanism is so designed that, when the paper cassette C is loaded into the cassette holder 40, the release lever 33 is pivoted from the disengaged position as shown in FIG. 3(*b*) towards the engaged position as shown in FIG. 3(*a*) against the torsion spring 34 with the other end of said release lever 33 held in contact with the paper cassette being loaded into the cassette holder 40, and when the paper cassette is removed from the cassette holder 40, the release lever 33 is pivoted from the engaged position towards the disengaged position by the action of the torsion spring 34 with the end 31*a* pressing the lever 31 to pivot clockwise against the spring 31*b*. Therefore, it is clear that, as the cassette C is removed from the cassette holder 40, the dispatching stand 32 is disengaged from the feed roller R as best shown in FIG. 3(*b*) to allow the copying paper, which would be held in a position sandwitched between the feed roller R and the dispatching stand 32, to be removed together with the removal of the cassette C from the holder 40. This is advantageous in that there is no possibility of the copying paper being left unremoved from the machine during the replacement or replenishment of the paper cassette.

Figure 4:
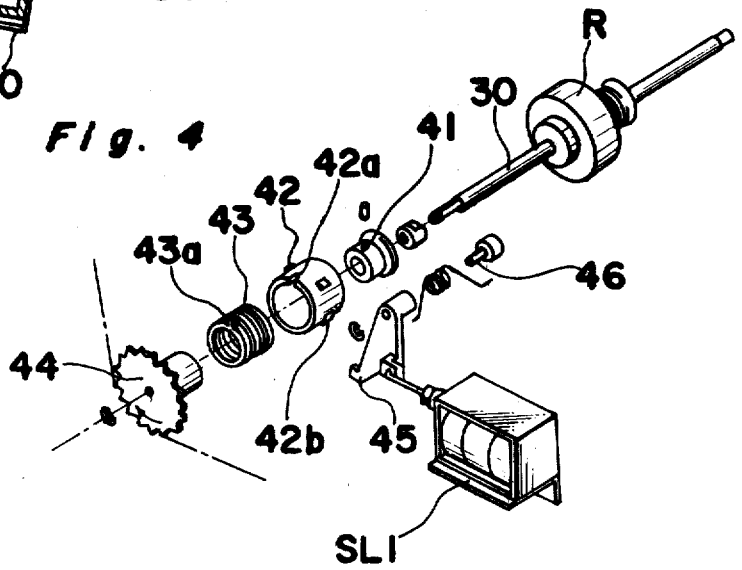
FIG. 4 is an exploded view of the paper feed assembly showing the details of a built-in clutch unit.
Figure 5A:
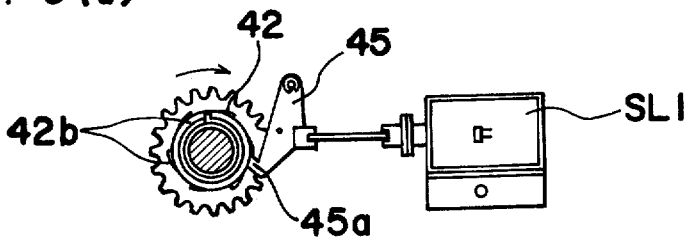
FIGS. 5(*a*) and 5(*b*) are side sectional views showing the clutch unit in different operative positions, respectively.
Figure 5B:
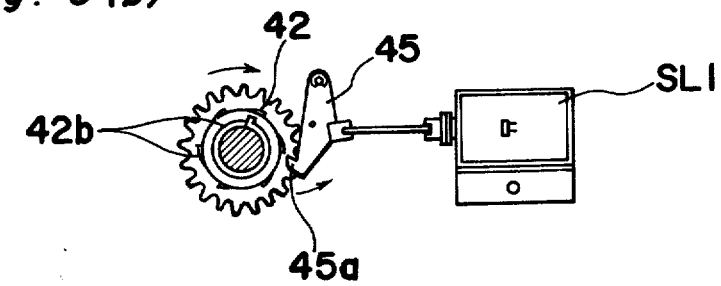

The details of the clutch unit are best shown in FIG. 4. This clutch unit comprises a clutch drum 41 rigidly mounted on the shaft 30 for rotation together therewith and also comprises a brake drum 42, a kick spring 43 and a sprocket wheel 44, all mounted on the shaft 30 for rotation independently of the rotation of the shaft 30. The kick spring 43 is so mounted on the shaft 30 as to selectively fasten the clutch drum 41 together with a boss portion of the sprocket wheel 44 and unfasten or release it therefrom and is positioned inside the brake drum 41 in such a manner that one end 43*a* is engaged in a notch 42*a* in the brake drum 42. The sprocket wheel 44 is operatively associated with a solenoid unit SL1 through a clutch lever 45. The clutch lever 45 is supported at one end by means of a pin 46 for pivotal movement between operative and inoperative positions and has a pawl portion 45*a* defined at the opposite end thereof remote from the pin 46 as best shown in FIGS. 5(*a*) and 5(*b*). The brake drum 42 has its outer peripheral surface formed with a plurality of circumferentially equally spaced ratchet teeth 42*b* with which the pawl portion 45*a* of the clutch lever 45 is engaged one at a time during deenergization of the solenoid unit SL1 as shown in FIG. 5(*a*) to interrupt rotation of the brake drum 42. When the rotation of the brake drum 42 is interrupted in this way with the pawl portion 45*a* of the clutch lever 45 engaged to one of the ratchet teeth 42*b* as shown in FIG. 5(*a*), the kick spring 43 is loosened thereby interrupting the transmission of a drive force of the sprocket wheel 44 to the shaft 30.

On the other hand, when and so long as the solenoid unit SL1 is energized with its plunger retracted as shown in FIG. 5(*b*), the pawl portion 45*a* of the clutch lever 45 is disengaged from any one of the ratchet teeth 42*b* to allow the kick spring 43 to fasten the boss portion of the sprocket wheel 44 and the clutch drum 41 together, resulting in the transmission of the drive force of the sprocket wheel 44 to the shaft 40 to rotate the latter.

While the present invention utilizes the clutch unit of the type employing the kick spring, the prior art has long employed a one-way, one-revolution clutch mechanism of a construction wherein the brake drum 42 has only a ratchet tooth defined thereon, which ratchet tooth is engaged by a pawl member, coupled to a solenoid unit or any other actuator, each time the brake drum 41 completes its 360° rotation. On the other hand, the paper feed roller R is so operable as to urge a stack of copying paper upward from bottom and also to feed each copying paper in frictional contact therewith when it is rotated. In view of this, if the diameter of the paper feed roller R is too small, the surface area of contact of the roller R to each copying paper is reduced with consequent reduction in both paper feeding capability and effect and, therefore, the timing at which the copying papers are fed in succession will be adversely affected. If the diameter of the roller R is made too large with a view to substantially eliminating the disadvantages and inconveniences caused by the use of a roller R of reduced diameter, plural copying papers tend to be supplied at one time and/or the copying paper fed and temporarily held standstill at either the intermediate roller assembly or the timing roller tends to warp or loop to such an extent that it results in jamming of the copying papers inside the machine housing or wrinkling the copying paper. Accordingly, it has long been considered extremely difficult to determine a suitable diameter of the paper feed roller R.

In view of the above, in the present invention, the brake drum 42 is so designed as to have a plurality of ratchet teeth 42*b* as described hereinbefore and, at the same time, the paper feed roller R of a relatively large diameter is employed to increase the paper feeding capability. Specifically, the brake drum 42 having the ratchet teeth 42*b* is so designed that the pawl portion 45*a* of the clutch lever 45 can be engaged to any one of the ratchet teeth 42*b* before the brake drum 42 completes its 360° rotation, thereby avoiding any possible feed of plural copying papers at one time. For this purpose, in the embodiment of the present invention so far illustrated, the brake drum 41 is formed with six ratchet teeth 42*b* on the outer peripheral surface thereof in circumferentially equally spaced relation to each other on the one hand and, on the other hand, the solenoid unit SL1 being energized is so designed as to be deenergized each time the brake drum 42 undergoes 4/6 to 5/6 of one complete rotation, the engagement of the pawl portion 45*a* of the clutch lever 45 to one of the ratchet teeth 42*b* stops the brake drum 42 when the brake drum 42 completes 5/6 of one complete rotation. It is, however, to be noted that the number of the ratchet teeth 42*b* and the time at which the engagement of the pawl portion 45*a* to one of the ratchet teeth 42*b* takes place actually may be determined in consideration of the diameter of the paper feed roller R, the pressing force of the stacked copying papers and the distance to the timing roller.

Figure 6:
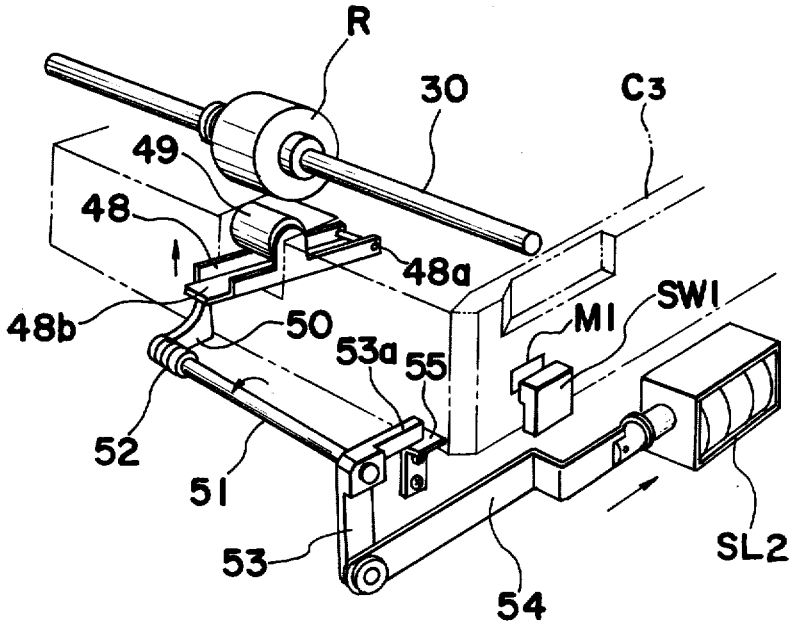
FIG. 6 is a perspective view showing a manual paper feed mechanism employed in the machine.

A manual paper feed mechanism employed in the machine embodying the present invention is shown in FIG. 6. Where a copying paper is desired to be manually supplied, a manual feed table C3 should be mounted and inserted in the machine at a position above the upper supply unit shown in FIG. 1. The feed table C3 has a magnet M1 rigidly secured to a front lateral portion thereof, which magnet M1 is operatively associated with a detector switch SW1. This switch SW1 detects the presence of the magnet M1, when the feed table C3 is inserted in the machine in readiness for the manual paper feed, not only to set the machine to work under a sequence control mode for manual paper feed but also to energize an indicator (not shown) for indicating to that effect. The feed table C3 has an elongated roller support 48 having one end pivotally connected at 48*a* to the table C3 and the other end 48*b* protruding outwards therefrom. This support 48 has a substantially intermediate portion on which a roller 49 is rotatably mounted in alignment with and immediately below the paper feed roller R. A connecting rod 51 having one end rigidly connected to an angle member 50 for pivoting the support 48 so as to engage and disengage the roller 49 to and from the roller R is rotatable supported by a machine framework and is normally biased counterclockwise by a torsion spring 52. The other end of the connecting rod 51 remote from the angle member 50 is coupled to a plunger of a solenoid unit SL2 by means of an L-shaped relay lever 53 and an intermediate lever 54.

In this construction, when a copying paper is manually inserted in between the rollers R and 49, a paper feed detector as will be described later is activated to energize the solenoid unit SL2 with the plunger consequently retracted. The retraction of the plunger of the solenoid unit SL2 results in the pivotal movement of the roller support 48 in a direction with the roller 49 engaged to the roller R to sandwitch the copying paper between the rollers R and 49. Simultaneously therewith, the clutch unit of the construction described hereinbefore is operated to cause the roller R to be driven to feed the copying paper into the machine. As the trailing edge of the copying paper so fed by the rotation of the roller R in cooperation with the roller 49 is moved past the paper feed detector, the solenoid unit SL2 is deenergized with the plunger thereof consequently projected, so that the roller support 48 is pivoted in the opposite direction with the roller 49 disengaged from the roller R. It is to be noted that, when the plunger of the solenoid unit SL2 is projected in a direction counter to the direction shown by the arrow in FIG. 6, one end of the relay lever 53 remote from the intermediate lever 54, which lever 53 is rotatable together with the connecting rod 51, is engaged to a stopper 55 to prevent further rotation of the relay lever 53 and, hence, the connecting rod 51. This stopper 55 is so adjustably secured to the machine framework that both the pressure of contact of the roller 49 to the roller R and the spacing between the rollers R and 49 which is established during disengagement of the roller 49 from the roller R can be adjusted.

Figure 7A:
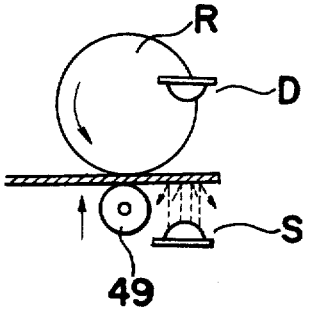
FIGS. 7(*a*) and 7(*b*) are schematic side views of a paper feed detector shown together with a copying paper in different positions, respectively.
Figure 7B:
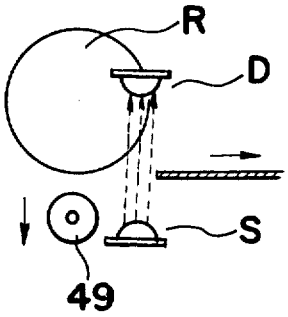

The paper feed detector is best shown in FIGS. 7(*a*) and 7(*b*) and comprises an ultrasonic wave generator S and a wave sensor D which are arranged on respective sides of the path of travel of the copying paper. This paper feed detector is so designed that, when and so long as the wave sensor D detects an ultrasonic wave generated from the generator S as shown in FIG. 7(*b*), the sensor D can provide an electric signal indicative of the absense of the copying paper.

Reference numeral 35 shown particularly in FIG. 2 represents a tuning fork secured to the lever 31 for absorbing, and thereby minimizing, noises which would be generated as a result of friction between the roller R and the dispatching stand 32.

In the present invention, the stacked copying papers with the cassette C are so designed as to be upwardly shifted to contact the roller R by an upwardly biased bottom plate operatively placed at the bottom of the cassette as the weight of the stacked copying papers reduces as a result of successive feed of the papers one at a time out of the cassette into the machine. This arrangement is advantageous in that the pressure of contact of the copying papers to the paper feed roller R can be maintained at a constant value irrespective of the reduction of the weight of the copying papers which would take place as the copying papers are successively consumed. In addition thereto, arrangement is made such that the upward shifting force exerted by the bottom plate on the stack of the copying papers can be adjustable depending on the size of the stacked copying papers in a particular paper cassette. Since the details of the above described arrangement are disclosed in the Japanese Patent Application No. 54-26544 filed in 1979 in Japan, by the same assignee of the present invention, they will not be described herein for the sake of brevity.

Figure 8:
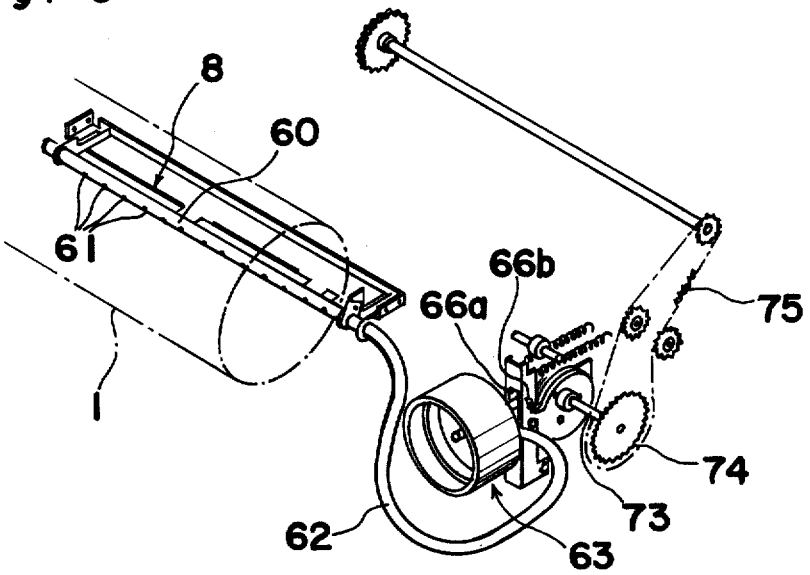
FIG. 8 is a perspective view of a paper separating machanism employed in the machine.

Paper Separating Mechanism:

In the present invention, as a means for separating the copying paper from the photoreceptor drum 1 shortly after the powder image has been transferred from the drum 1 onto such copying paper, a row of air jets blown from a nozzle assembly 8 is utilized. This will now be described with particular reference to FIGS. 8 and 9.

Figure 9A:
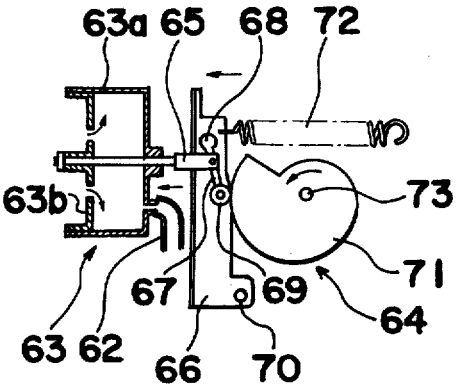
FIGS. 9(*a*) and 9(*b*) are side views of the paper separating mechanism in different operative positions, respectively.
Figure 9B:
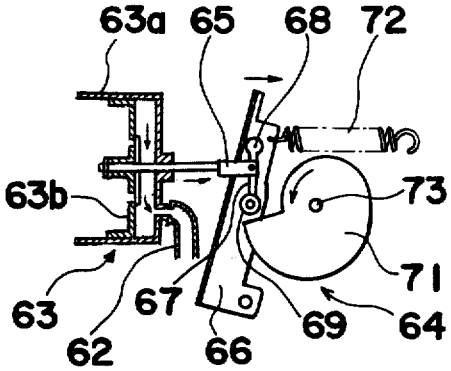

The nozzle assembly 8 is shown as comprising a pipe 60 having a row of perforations 61 defined therein in a direction lengthwise thereof and supported in position in parallel relation to, and also in the vicinity of, the photoreceptor drum 1, the position of said pipe 60 being however adjustable relative to the photoreceptor drum 1. While one end of the pipe 60 is closed, the other end of the same pipe 60 is fluid-connected to an air pump 63 through a flexible hose 62. The air pump 63 is of a construction, as best shown in FIGS. 9(*a*) and 9(*b*), comprising a hollow cylinder 63*a* having a piston 63*b* housed therein for reciprocal movement in an axial direction of the cylinder 63*a* with its outer periphery held slidingly in contact with the inner peripheral wall of the cylinder 63*a*, said piston 63*b* being in turn connected to an actuating mechanism 64 by means of a connecting rod 65. A free end of the connecting rod 65 remote from the piston 63*b* extends through a slot 66*a* defined in a charge lever 66 and is then pivotally connected to a link 67 connecting a pin 68 and a charging shaft 69 together, which pin 68 is supported in slots 66*b*, defined in respective lateral opposed walls of the charge lever 66, for movement in a lengthwise direction along the slots 66*b*. The charging shaft 69 is rotatably supported in position by the charge lever 66 and extends in parallel relation to the pin 68. The charge lever 66 is in turn pivotally supported by a pin 70 on the machine framework and is normally biased counterclockwise about the pin 70 by the action of a spring 72 with the charging shaft 69 consequently held in contact with a cam wheel 71, whereby when the cam wheel 71 rotated in a manner as will be described subsequently, the shaft 69 undergoes a rocking motion about the pin 70 to reciprocately move the piston 63*b* inside the cylinder 63*a*. The charge cam wheel 71 is mounted through a clutch (not shown) on a drive shaft 73 having a driven gear 74 rigidly mounted thereon and adapted to be driven by an endless transmission chain 75.

The cam wheel 71 is normally held in such a condition as shown in FIG. 9(*a*). In this condition of FIG. 9(*a*), the cam wheel 71 is in position to urge the charge lever 66 in a direction counterclockwise about the pin 70 with the piston 63*b* displaced to the left as viewed in FIG. 9(*a*). At a predeterminded timing subsequent to the start of the copying operation, the clutch is coupled to rotate the cam wheel 71 in a direction counterclockwise about the shaft 73, permitting the charge lever 66 to pivot clockwise about the pin 70 as biased by the spring 72 with the charging shaft 69 slidingly contacting and following the contour of the cam wheel 71. However, shortly after the cam wheel 71 has been rotated counterclockwise, the lever 66 is rapidly pivoted clockwise by the action of the spring 72 with the charging shaft 69 falling in a step defined in the cam wheel 71 and, as a consequence thereof, the connecting rod 65 rapidly pulls the piston 63*b* in a direction towards the right as shown. The rapid displacement of the piston 63*b* to the right as shown in FIG. 9(*b*) permits air contained in the cylinder 63*a* to be discharged to the pipe 60 through the hose 62, with the pipe 60 producing air jets through the perforations 61. The continued rotation of the cam wheel 71 in the counterclockwise direction results in the return of the piston 63*b* to the left as shown in FIG. 9(*a*) and is brought to a halt when such a condition as shown in FIG. 9(*a*) is established.

The air jets so produced from the pipe 60 are applied in between the photoreceptor drum 1 and the copying paper to separate the latter from the drum 1 and being then rotated.

Optical Scanning System:

The details of the optical scanning system are shown in FIGS. 10 to 14.

Figure 10:
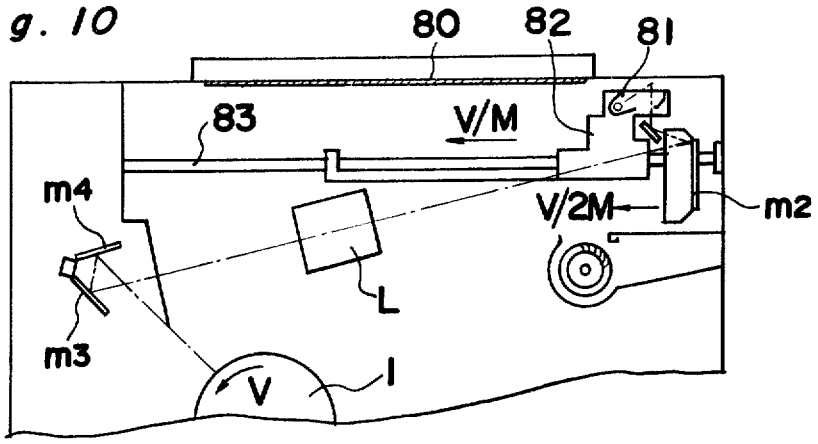
FIG. 10 is a schematic side view showing an optical scanning system employed in the machine.

The original to be copied, which has been placed on an original support 80, is scanned by a scanner 82, including an illuminating lamp 81 and a first reflective mirror $m_1$, as the scanner is moved towards the left as viewed in FIG. 10 along a guide rail 83. Rays of light reflected from the original and, therefore, carrying the image of the original are reflected by the first reflective mirror $m_1$ towards a second reflective mirror $m_2$ movable along the guide rail 83 in pursuit of the scanner 82, which second reflective mirror $m_2$ reflects the light rays towards a third reflective mirror $m_3$ through a lens unit L. The light rays are, after having been reflected by the third reflective mirror $m_3$ and then by a fourth reflective mirror $m_4$, projected onto the photoreceptor drum 1. It is to be noted that the scanning velocity V1 is expressed by the equation, $V1=V/M$, wherein V represents the speed of transportation of any one of the photoreceptor drum 1 and the copying paper and M represents a magnification power of the lens unit L while the second reflective mirror $m_2$ is moved in pursuit of the scanner 82 at a speed V2 which is expressed by the equation, $V2=V/2M$.

Figure 11:
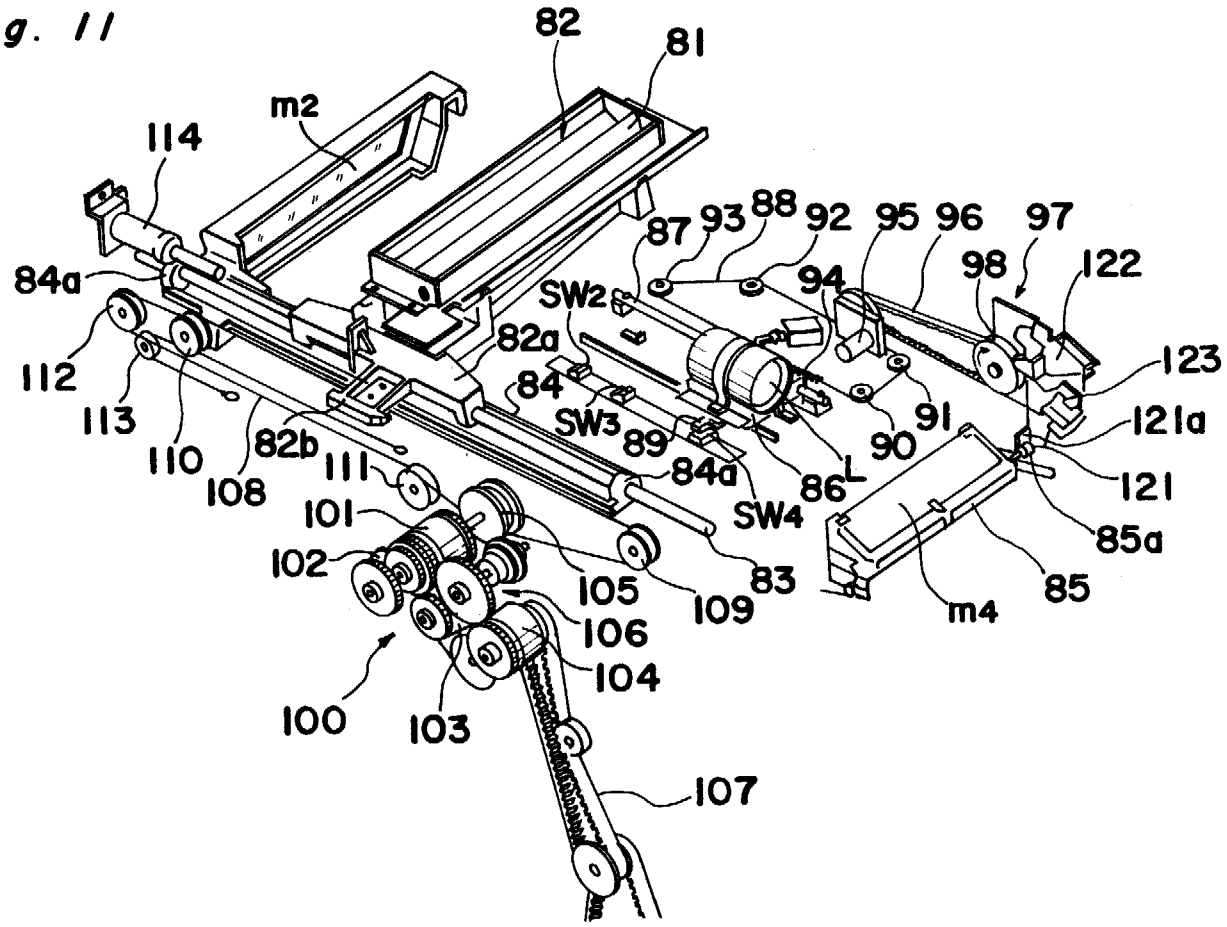
FIG. 11 is a perspective view showing an arrangement of mechanical component parts of the optical scanning system.

As best shown in FIG. 11, the scanner 82 has the lamp 81 stationarily mounted thereon and is supported by a holder 82*a* mounted on the guide rail 83 for movement therealong. Although the second reflective mirror $m_2$ is supported by a holder 84 slidingly movable along the guide rail 83, two supporting portions 84*a* of the holder 84 are located on respective sides of the scanner 82 and spaced from each other a distance sufficient to prevent the movement of the scanner 82 from being hampered. The third and fourth reflective mirrors $m_3$ and $m_4$ are mounted on the same holder 85 which is adjustably supported by the machine framework. The lens unit L is fixedly mounted on a lens holder 86 mounted on a guide rail 87 for movement therealong, a force necessary to move the lens holder 86 along the guide rail 87 being transmitted thereto by means of a cable 88. The lens holder 86 carries a magnet 89 rigidly secured thereto, which magnet 89 is operatively associated with reed switches SW2, SW3 and SW4. These reed switches SW2, SW3 and SW4 are so arranged along the path of movement of the lens holder 86 as to be actuated by the magnet 89 one at a time when the lens unit L is set to any one of different magnifications. The cable 88 is connected to the lens holder 86 by means of a tension spring 94 and, while it is turned around idler pulleys 90, 91, 92 and 93, is adapted to be driven by a drive pulley (not shown), operatively coupled to a drive motor 95, to move the lens unit L selectively to any one of the positions of the different copying magnifications, which positions are respectively represented by the positions of the reed switches SW2, SW3 and SW4. The movement of the lens unit L to any one of the magnification positions is carried out by driving the motor 95 in either direction by the utilization of a signal which is generated incident to selection of one of the copying magnifications to which the image of the original is desired to be enlarged or reduced, the drive of the motor 95 being also transmitted through an endless belt 96 to a cam wheel 98 to adjust the position of both of the third and fourth reflective mirrors $m_3$ and $m_4$ so that change in conjugate distance resulting from the movement of the lens unit L can be compensated for. The details of a position adjusting mechanism including the cam wheel 98 will be described later with particular reference to FIGS. 13 and 14. A drive mechanism for the scanner 82 and the second reflective mirror $m_2$ comprises first, second and third scanner clutches 101, 102 and 103, a return clutch 104, a drive pulley 105 and a cable 108 turned around the drive pulley 105. A drive during the scanning is transmitted to gears (not shown) fasten onto respective shafts of the second and third clutches 102 and 103 through timing belts (not shown), the driving force thereof actuating one of the scanner clutches, corresponding to the selected copying magnification, to drive the pulley 105 at a predetermined velocity. This predetermined driving velocity is determined by a gear ratio so selected as to cause the scanner 82 and the first reflective mirrors can be moved at the respective velocities of V/M and V/2M described hereinbefore. Reference numeral 106 represents a braking device operable during the scanning to impose a suitable load on the drive system to prevent the moving velocity from being adversely affected by mechanical noises.

The return clutch 104 is adapted to receive a driving force transmitted through a timing belt 107 from a motor (not shown) for the developing unit. This arrangement is employed for the purpose of avoiding any possibility that, since the velocity during the return movement is so selected as to be higher than that during the scanning, the return will be initiated during the image forming operation with the increased load consequently imposed on the photoreceptor drum to such an extent as to result in fluctuation in the speed of rotation of the photoreceptor drum 1 if the driving force from a main motor for driving the photoreceptor drum 1, which is utilized during the scanning, is also used even during the return movement.

The cable 108 turned around the drive pulley 105 is secured to the holder 82*a* for the scanner 82 through a fixed pulley 109 and is connected at one end to the machine framework after having been turned around a movable pulley 110 carried by the holder 84 for the second reflective mirror $m_2$ and at the other end to the machine framework after having been turned around a fixed pulley 111, a fixed pulley 112, the movable pulley 110 and a fixed pulley 113. By this arrangement, the second reflective mirror $m_2$ can be moved at the velocity of V/2M while the scanner 81 is moved at the velocity of V/M.

In the construction shown in FIG. 11, reference numeral 111 represents a shock absorber operable to cushion the optical scanning system during the return movement. The first, second and third clutches are provided in association with, for example, ×1, ×0.7 and ×0.8 magnifications, respectively.

Figure 12:
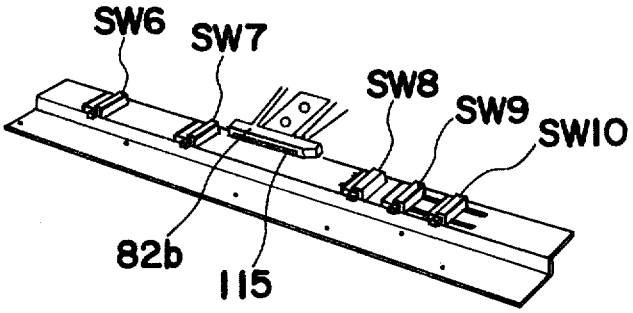
FIG. 12 is a perspective view showing an arrangement of various switches operatively associated with the optical scanning system.

In FIG. 12, various control reed switches SW6, SW7, SW8, SW9 and SW10 and their associated actuating mechanism, which are necessary to achieve a synchronism between the copying paper being transported and the scanning of the original during the movement of the optical scanning system, are illustrated. A magnet 115 effective to selectively actuate the reed switches SW6 to SW10 one at a time as it is moved past these reed switches SW6 to SW10 is carried rigidly by a carrier projection 82*b* protruding from the holder 82*a* for the scanner 82. Specifically, the reed switch SW6 is actuated by the magnet 115 when and so long as the optical scanning system is held at a start position; the reed switch SW7 is actuated by the magnet 115 to generate a reference signal which is utilized both for generating operating reference signals for operating a group of timers for sequence control as will be described later and for detecting an abnormal operating condition of the optical scanning system; and the reed switches SW8, SW9 and SW10 are timing switches which are selectively utilized when the lens unit L is held at the ×1, ×0.8 and ×0.7 magnification positions, respectively. It is to be noted that, in place of the reed switches SW6 to SW10, either microswitches or optical sensors may be employed.

The position adjusting mechanism for both of the third and fourth reflective mirrors $m_3$ and $m_4$ will now be described with reference to FIGS. 13 and 14. This adjusting mechanism is generally identified by 97 and is provided for adjusting the position of both of the reflective mirrors $m_3$ and $m_4$ to compensate for variation in optical conjugate distance in an optical path between the original and the photoreceptor drum 1 which takes place when the lens unit L is moved to any one of the ×1, ×0.8 and ×0.7 magnification positions.

The cam wheel 98 forming a part of the adjusting mechanism 97 and referred to hereinbefore is rotated by the motor 95 for moving the lens unit L, the angular distance through which said cam wheel 98 is rotated corresponds to the distance over which the lens unit L is moved to any one of the magnification positions. For this purpose, the cam wheel 98 is so designed as to have three cam faces A, B and C to which a roller 120 as will be described later is rollingly engaged when the lens unit L is moved selectively to the ×1, ×0.8 and ×0.7 magnification positions, respectively.

The mechanism 97 also comprises a mirror adjusting lever 121 positioned adjacent to the cam wheel 98 and supported at an upper end for pivotal movement, said lever 121 carrying first and second levers 122 and 123 mounted thereon for fine adjustment. The roller 120 referred to above and engaged to the cam wheel 98 is provided at respective tip portions 122*a* and 123*a* of the first and second levers 122 and 123. The free end of the mirror adjusting lever 121 opposite to the point of pivot thereof is bent frontwardly with respect to the plane of the drawing of FIG. 13 to define a flange 121*a*, to which flange 121*a* a holder roller 85*a* rigidly secured to the holder 85 for the third and fourth reflective mirrors $m_3$ and $m_4$ is engaged. Since the holder 85 is normally biased towards the left as viewed in FIG. 13 by the action of a biasing spring (not shown), the roller 85*a* is constantly engaged to the flange 121*a* of the adjusting lever 121 so that, by changing the position of the flange 121*a*, the position of the third and fourth reflective mirrors $m_3$ and $m_4$ can be adjusted.

Figure 13:
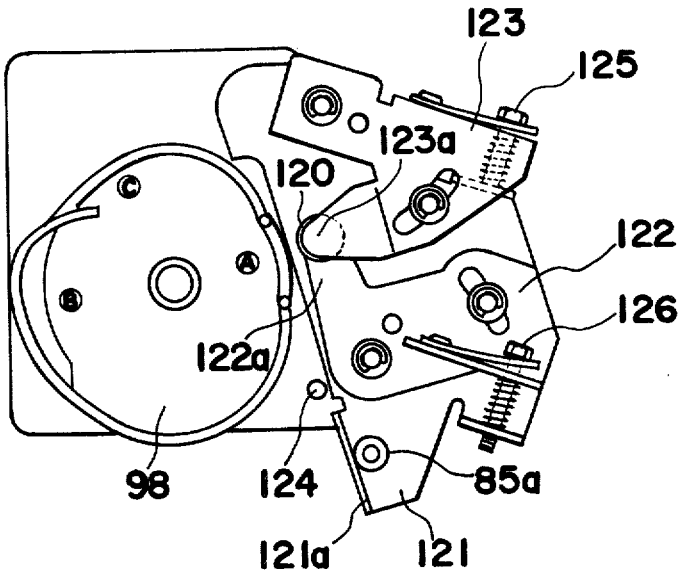
FIG. 13 is a side view showing a position adjusting mechanism for a reflector employed in the optical scanning system.

FIG. 13 illustrates the cam wheel 98 held in a position corresponding to the maximum available magnification, that is, ×1 magnification, in which condition the cam face A is held in face-to-face relation to the roller 120. In this condition, the roller 120 is not engaged to the cam face A because the adjusting lever 121 is engaged against a stopper 124. However, when the cam wheel 98 is rotated to bring the cam face B in position to confront with the roller 120 incident to the change of magnification, since the cam face B is in a form protruding frontwardly with respect to the plane of the drawing of FIG. 3, the cam face B engages the roller 120, which is carried by the tip portion 122*a* of the first lever 122 protruding frontwardly in a manner similar to the cam face B, to push the roller 120 in such a manner as to cause the adjusting lever 121 to pivot counterclockwise as shown in FIG. 14(*a*). By this counterclockwise movement of the lever 121, the holder roller 85*a* is displaced towards the right thereby to change the position of the mirrors $m_3$ and $m_4$. It is to be noted that, since the levers 122 and 123 are finely adjustably mounted on the lever 121 by means of respective adjustment bolts 125 and 126, fine adjustment of one or both of the levers 122 and 123 results in focusing adjustment of the lens unit L at each of the magnification positions of said lens unit L.

Figure 14A:
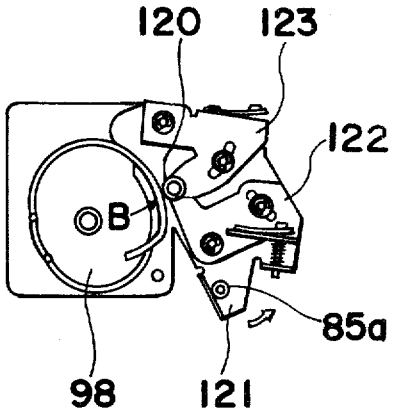
FIGS. 14(*a*) and 14(*b*) are views, similar to FIG. 13, showing the position adjusting mechanism in different operative positions, respectively.
Figure 14B:
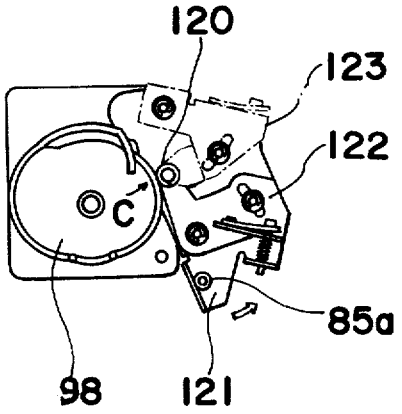

When the cam wheel 98 is further rotated until the roller 120 is brought into engagement with the cam face C as shown in FIG. 14(*b*), the roller 20 so engaged to the cam face C is the one carried by the tip portion 123*a* of the second lever 123. Even in this condition, the adjusting lever 121 is pivoted in a manner similar to that described with reference to FIG. 14(*a*).

As hereinbefore described, the cam faces A, B and C are so designed and so shaped as to adjust the conjugate distance when the lens unit L is set selectively at the ×1, ×0.7 and ×0.8 magnification positions.

Control System

The copying machine embodying the present invention utilizes the micro-computer for controlling the sequence of operation thereof. Hereinafter, the control scheme and controls of the component parts of the machine, performed by the micro-computer, will be discussed.

[Control Scheme: Basic Concept]

Figure 15:
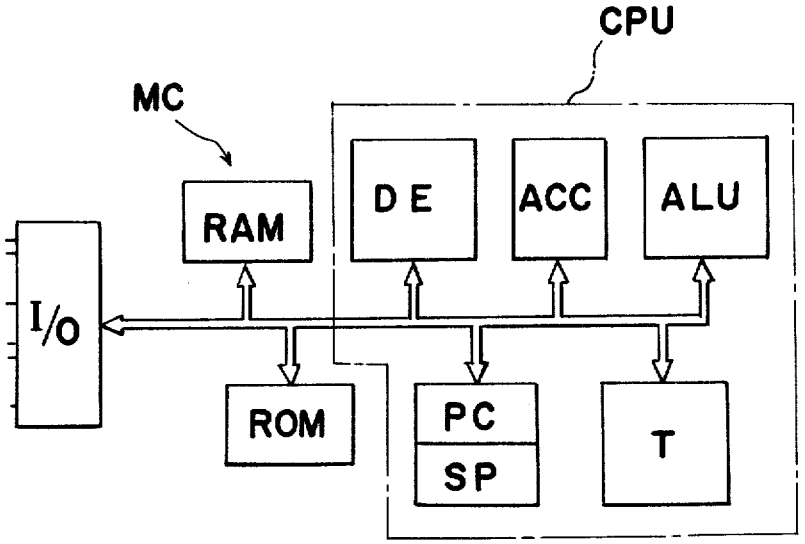
FIG. 15 is a schematic block diagram showing component parts of a micro-computer in general.

As shown in FIG. 15, the micro-computer MC basically comprises a central processing unit CPU including an accumulator ACC, a control and command decoder DE, a program counter PC, stack pointer SP composed of a group of registors, a timer T, and an arithmetic-logic unit ALU, a random access memory RAM composed of semiconductor memories, a read-only memory ROM, and an input/output interface I/O for receiving signals applied from and applying control signals to, external circuit components. Input signals to be received by the micro-computer are fed thereto through the input/output interface I/O and, likewise, control signals generated from the micro-computer MC are fed to external circuit components and/or electrically operated component parts through the input/output interface I/O.

So far as the micro-computer MC is involved, since a variety of types are currently available, any one of them can be utilized in the present invention if it is selected as serviceable for the intended purpose and, therefore, the details thereof will not herein be described.

The basic concept of the sequence control performed by the micro-computer MC in the copying machine embodying the present invention, as well as problems and their solutions will now be discussed.

(a) Timer in Micro-computer

The micro-computer MC utilizes a clock pulse generator PG1 having a quartz oscillator, said clock pulse generator PG1 generating a train of clock pulses P1 of a frequency usually in the order of KHz which provide a minimum operating unit of the micro-computer. By combining the clock pulses in a number equal to a desired number of commands, a predetermined program can be obtained. Let it be assumed that a train of pulses P2 is generated each time one routine of the program completes.

When the sequence of operation of the copying machine is to be controlled by the micro-computer MC, the train of pulses P2 is further counted by a counter, the counted value being then compared with the numerical data which have been stored in said program. Each time the counted value coincides with the numerical date, a predetermined control signal is generated to control, for example, the timing of ON-OFF of the illuminating lamp. This is a basic concept of control performed by the timer built in the micro-computer.

Figure 16:
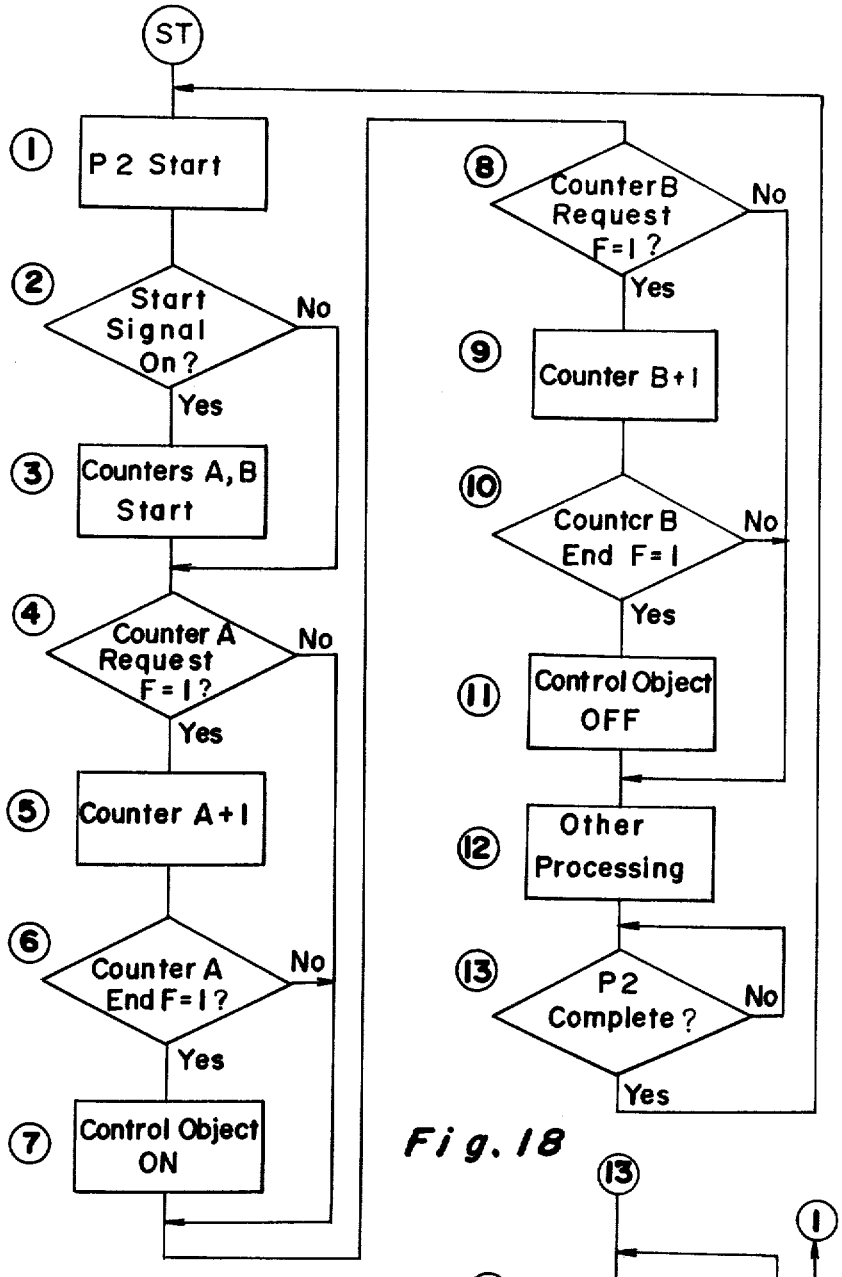
FIG. 16 is a flow chart showing the sequence of control of a timer performed by the micro-computer.

A flow chart explanatory of the basic concept of control performed by the micro-computer timer is shown in FIG. 16, reference to which will now be made.

Referring to FIG. 16, the step ① illustrates that the microcomputer has been fed with electric power as a result of the closure of, for example, a main switch of the copying machine, one routine of operation of the microcomputer MC has been initiated, and the counting (division) of the pulse train generated from the clock pulse generator PG1 has been initiated. At the subsequent step ②, determination is made as to whether a start switch for starting operation of a device, for example, a "Print" switch for starting the copying operation, or a timing switch for synchronism subsequent to the closure of the "Print" switch has been closed or not. If the "Print" switch or the timing switch is found to be closed, the process proceeds to the step ③ at which time counters C-A and C-B start their counting operation. These counters C-A and C-B are incremented by 1 each time one routine of the program completes.

At the step ④, check is made as to whether or not the counter C-A should be incremented by 1. (So long as the request flag is 1, +1 increment is continued.) If the flag is found to be 1, the process proceeds to the step ⑤ at which the counter C-A is increment by 1.

At the step ⑥, the counted value of the counter C-A is compared with the numerical data concerning the timing at which the control object to be controlled should be ON and, if they coincide with each other, the process proceeds to the step ⑦ at which an ON signal is generated.

The steps ⑧ to ⑪ are similar to the above described steps ① to ⑦, but differ therefrom in that the timing at which the control object should be OFF is determined by the counted number of the counter C-B.

The step ⑫ illustrates processings of one routine other than ON and OFF control of the control object.

The step ⑬ is to determine whether or not one cycle of the pulses P2 has completed, that is, whether or not a predetermined number of pulse trains P1 generated from the clock pulse generator PG1 has been counted. If it has completed or been counted, the process proceeds back to the first step ①.

Important to note in the foregoing description made with reference to FIG. 16 is that the steps ① to ⑬ constitute one routine of the program and that, where the timing signal required to hold, for example, a lamp in an ON state is so programmed as to be generated when the value counted by the counter C-A attains "100", the routine of the program is repeated 100 times before such timing signal is actually generated. Accordingly, in this case, where a timing signal required to hold the lamp in an OFF state is so programmed as to be generated when the counted value of the counter C-B attains "200", such timing signal is generated after the routine has been further repeated 100 times subsequent to establishment of the ON state of the lamp. (Nevertheless, during this repetition, the ON-OFF states of other mechanical elements are controlled.)

(b) Problem of Sequence Control by Timer . . . I

As has been clarified from the foregoing description, the control signal generated by the timer of the microcomputer is generated exactly at a particular timing and gives no error so long as an operating voltage required to operate the microcomputer is supplied thereto without deviating from the rated value.

On the contrary thereto, in a motor-driven mechanical device such as the previously described copying machine, since an electric power required to drive the motor is supplied from commercial electric power outlet, variation in source voltage which usually takes place within the range of ±10% renders it difficult to maintain the speed of rotation of the motor at a constant value. Accordingly, this variation of the source voltage often constitutes a cause of variation in the speed of transportation of the copying paper as well as the speed of rotation of the photoreceptor drum 1.

When it comes to the employment of the microcomputer for controlling the sequence of such a copying machine as involving an uncertainty as to the driving speed such as discussed above, there may arise such a possibility that the powder image is transferred from the photoreceptor drum 1 onto the copying paper in a displaced manner because of the uncertainty of the speed of transportation of the copying paper, even though a timing signal required to start the transportation of the copying paper so that it can be synchronized with the speed of rotation of the photoreceptor drum 1 is generated from the microcomputer at a predetermined timing after the "Print" switch has been held on an ON state. The displaced transfer of the powder image from the photoreceptor drum 1 onto the copying paper results in reproduction of the image of the original on an incorrect portion of the copying paper.

In the copying machine embodying the present invention, the following solution is employed to substantially eliminate the above discussed inconvenience, which will be described with reference to FIG. 17.

Figure 17A:
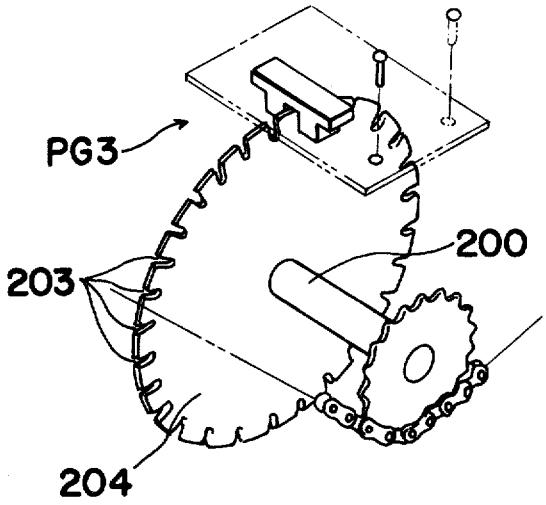
FIGS. 17(*a*) and 17(*b*) are perspective views illustrating an electro-mechanical pulse generator.
Figure 17B:
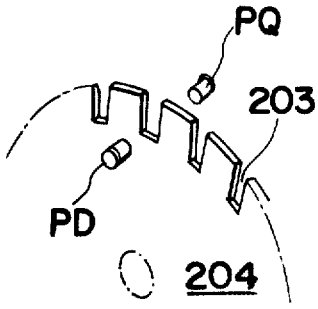

Referring to FIGS. 17(*a*) and 17(*b*), a motor drive shaft 200, or any other shaft driven by the motor, has a disc 204 rigidly mounted thereon for rotation together therewith. This disc 204 has a plurality of circumferentially equally spaced slits 203 extending radially inwardly from the outer peripheral edge thereof. A lamp PD and a light receiving element PQ are supported in alignment with each other on respective sides of the disc 204 such that, during the rotation of the disc 204 together with the shaft, rays of light emitted from the lamp PD and passing through the slits 203 are received by the light receiving element PQ which converts the pulsating light rays detected thereby into a train of electric pulses P3. In this arrangement, the disc 204, the slits 203, the lamp PD and the light receiving element PQ constitute a pulse generator PG3.

The frequency of the pulses P3 generated from the pulse generator PG3 of the construction described above varies according to variation in speed of rotation of the motor. The higher the speed of rotation of the motor, the smaller the duration of each pulse P3, and vice versa. Thus, the rate of change in duration of each pulse P3 corresponds to variation in speed of rotation of the motor. It is to be noted that the pitch between each adjacent two slits 203 is so selected that the duration of each pulse P3 generated from the pulse generator PG3 when the motor is rotated at a maximum possible speed is larger than that of each pulse P2 referred to hereinbefore.

Figure 18:
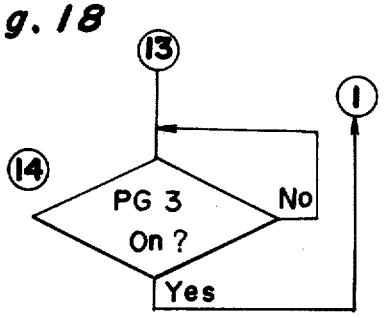
FIG. 18 is a flow chart employed for the explanation of the timer control performed by the utilization of the electro-mechanical pulse generator.

The train of pulses P3 so generated from the pulse generator PG3 is supplied to the microcomputer, the program therefor being such that, as shown in FIG. 18, after one cycle of the pulses P2 has been found completed at the step (13) shown in FIG. 16 during each routine of the program, the step (13) shown in FIG. 16 is followed by the step (14) prior to being proceeded back to the step (1). At the step (14) as shown in FIG. 18, check is made as to whether or not the train of the pulses P3 has been generated from the pulse generator PG3 and, if it is found generated, the process proceeds to the step (1) shown in FIG. 16.

The relationship between the train of the pulses P3 generated from the electromechanical pulse generator PG3 and the control signal from the microcomputer will now be described with reference to FIG. 19.

Figure 19A:
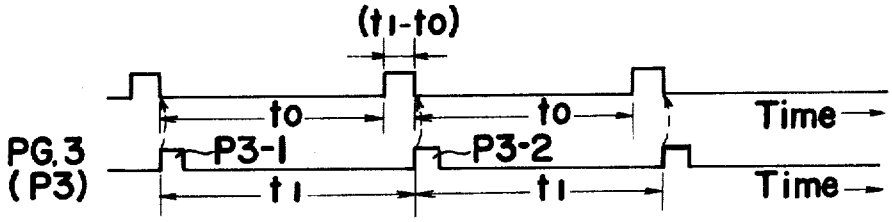
FIGS. 19(*a*) and 19(*c*) are graphs showing three different methods for the timer control, respectively.
Figure 19B:
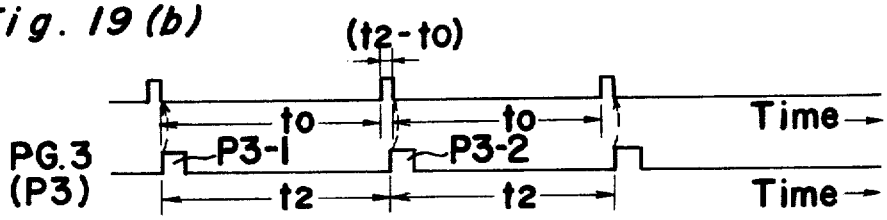
Figure 19C:
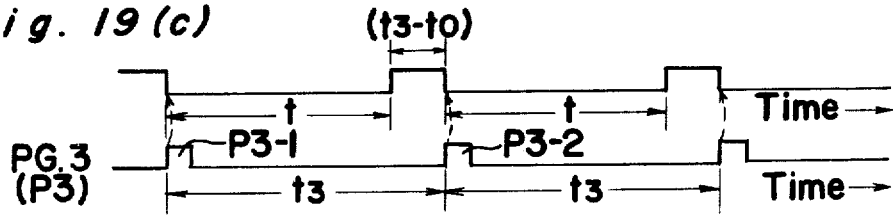

The relationship shown in FIG. 19(*a*) applies where the motor is rotated at a standard speed. Upon generation of the first pulse $P_{3\text{-}1}$ of the pulse train P3 in synchronism with the rotation of the motor, the program routine proceeds back to the step (1) shown in FIG. 16 whereat the pulse train P2 starts, that is, the program routine is initiated. After the lapse of a time to, the pulse train P2 is, at the step (13), checked as to whether completed or not completed. (At this time, one routine of the program has already been completed.) Subsequently, generation of the next succeeding pulse $P_{3\text{-}1}$ of the pulse train P3 is confirmed at the step (14) and, thereafter, the process proceeds back to the step (1) to initiate the next succeeding routine of the program. Accordingly, assuming that the frequency of the pulse train P3 at this time is expressed by $t_1$, the difference between $t_1$ and $t_0$ represents a time during which the microcomputer is held in a stand-by condition.

FIG. 19(*b*) illustrates the relationship applicable where the motor is rotated at an increased speed. In this case, the frequency of the pulse train P3 is shown by $t_2$ which is lower than the frequency $t_1$. Accordingly, the stand-by time $t_2-t_0$ is shortened as shown. However, if the frequency $t_2$ of the pulse train P3 is set to be necessarily larger than the time $t_0$, one routine processing of the microcomputer would not be adversely affected. In addition, since the timing at which the process proceeds back to the step (1), is accelerated by the generation of the second pulse $P_{3\text{-}2}$, the operation of the microcomputer can cope with variation in speed of the copying machine.

FIG. 19(*c*) illustrates the relationship applicable where the frequency $t_3$ of the pulse train P3 becomes higher than the frequency $t_1$, that is, the motor is rotated at a reduced speed. In this case, since the stand-by time $t_3-t_0$ is prolonged, the timing at which the pulse train $P_2$ is initiated is delayed for a time corresponding to the value through which the speed of rotation of the motor has been reduced and, accordingly, the operation of the microcomputer can cope with the reduced speed of rotation of the motor.

Important to note in connection with the foregoing description is that the time $t_0$ required for the microcomputer to complete one routine of the program does not vary with correspondingly no change in the program being performed by the microcomputer and that, as previously described, each of the counters C-A and C-A is incremented by 1 for each routine. If the speed of rotation of the motor varies, the standy-by time between the time of completion of one routine to the start of the next succeeding routine varies, but no numerical data stored in the program will vary.

(c) Problem of Sequence Control by Timer . . . II

The problem associated with the relationship between the control signal from the microcomputer and variation in speed of the copying machine is solved in the manner as discussed under the preceding subheading (b).

The other problem associated with the microcomputer is such as discussed hereinbelow.

Figure 20:
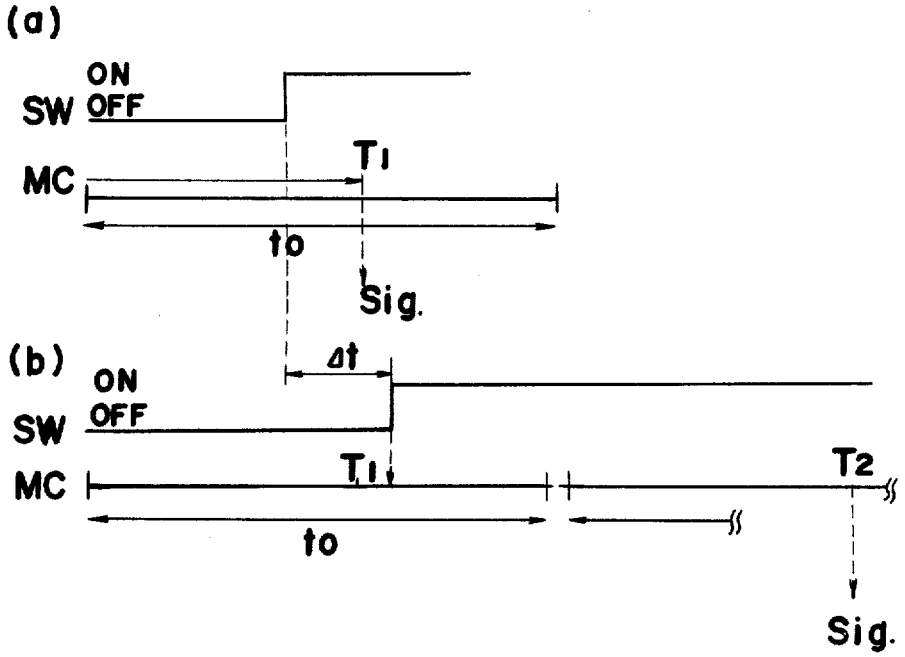
FIG. 20 is a graph showing the operative relation of a detector for detecting the operation of a switch with the operation of the micro-computer.

As shown in the flow charts of FIGS. 16 and 18, during one routine, the timing at which the control signal is supplied outside is determined by which step it is supplied to the outside. In other words, assuming that 10 msec. is required to complete one routine, there is a delay of 10 msec. between the first and last steps. In the microcomputer of this type, the taking-in and generation of signals from and to external circuits, respectively, are similarly checked at predetermined steps during one routine. For the purpose of illustration, let it be assumed that, as shown in FIGS. 20(*a*) and 20(*b*), the ON-OFF state of a predetermined switch SW is checked at a timing T1 subsequent to the start of the processing of one routine. Shown in FIG. 20(*a*) is a case where, since the switch SW is found to be held in an ON state at the timing T1, a control signal Sig is generated at that timing to initiate a predetermined operation. FIG. 20(*b*) is the case where, since the switch SW is found to be held in an OFF state at the timing T1, the time at which the control signal Sig is actually generated is the timing T2 during the next succeeding routine. However, the timings at which the switch SW is held in the ON state shown respectively in FIGS. 20(*a*) and 20(*b*) are displaced a difference $\Delta t$ from each other, which difference $\Delta t$ usually occurs in any type of machines and, therefore, is considered falling within the tolerance. The time at which the control signal Sig is generated in the case of FIG. 20(*a*) and that in the case of FIG. 20(*b*) are displaced from each other a period of time equal to that required to complete one routine, that is, 10 msec. or more.

Although the delay of 10 msec. discussed above appears not problematical, the delay of 10 msec. corresponds to or results in displacement of 2 mm in the case, for example, where the copying paper is transported at a speed of 20 cm/sec. Accordingly, if the generation of the control signal required to start the transportation of the copying paper is delayed 10 msec., the image of the original reproduced on the copying paper will be displaced 2 mm. This may present a problem to be solved, depending on the application. Yet, the higher the copying speed, the larger this delay.

In the copying machine embodying the present invention, the above discussed problem is solved by the following measures which will be described with particular reference to FIG. 21. It is to be noted that, for the sake of brevity, the control of the timing at which the rotation of only the timing roller 20 (FIG. 1) is initiated is taken into consideration in the description that follows with reference to FIG. 21. As hereinbefore described, the timing roller 20 is operable to temporarily stop the leading edge of the copying paper and then to transport it after having synchronized with the powder image on the photoreceptor drum 1.

Figure 21:
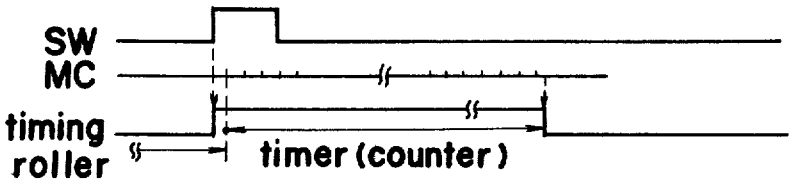
FIG. 21 is a graph showing the operation of a timing roller in relation to the micro-computer.

As shown in FIG. 21, when a switch SW which is depressed incident to the start of the copying operation of the copying machine, (for example, the timing switches SW8 to SW10,) is held in an ON state, the timing roller 20 is rotated, and the microcomputer will control the timing at which the drive of the timing roller 20 should be interrupted. That is to say, if the rotation of the timing roller 20 is initiated in response to the ON state of the switch SW, irrespective of whether the ON state has a particular relationship with the routine of the microcomputer, there is no displacement. However, since the timing at which the roller 20 is brought to a halt is not required to be controlled accurately so much as the time at which the roller 20 is initiated to rotate, an arrangement is made to cause the microcomputer to bring the timing roller 20 to a halt.

It is to be noted that the timer control of the microcomputer is preferred and advantageous since the timing at which the timing roller 20 should be brought to a halt varies from time to time depending on the size of the copying paper being used and/or a combination of copying condition during multi-copying operation of the machine.

[Paper Feed Control]

The copying machine embodying the present invention has hereinbefore described as having the upper and lower paper supply units accommodating therein the paper cassettes, the copying papers being fed one at a time from one of the paper cassettes by the action of the corresponding paper feed roller R1 or R2 which has been selectively brought into operation. The manual paper feed mechanism, and the mechanism for and the reason of feeding the copying paper by the rotation of the paper feed roller through an angle corresponding to 5/6 of the 360° rotation have also been described hereinbefore. However, hereinafter the paper feed mechanism will be described in association with the size of the copying papers in the corresponding paper cassette and the sequence mode control performed by the control mechanism using the microcomputer.

The control of the paper feed mechanism will first be described with particular reference to FIG. 22.

Assuming that electric power is supplied to the copying machine, the microcomputer MC is also fed with electric power to start its control operation. The paper feed control performed by the microcomputer MC is such that, where the upper cassette is selected at the step ① from a start signal section, the flag is set to "1". At the step ②, an "Empty" indicator is turned off. UP represents a determination flag. When this flag UP is set to "1", this means that one of the paper feed rollers which is associated with the upper cassette in the upper supply unit, that is, the roller R1, is brought into operation. The selection as to which one of the rollers R1 and R2 should be brought into operation is determined at the will of the operator of the machine, and a signal thereof is supplied to the determination flag UP in the central processing unit CPU through the interface I/O. As a result of this, the following control is performed in accordance with the program, stored in the read-only memory ROM, in dependence on the contents of the determination flag UP. At the step ③, the contents of the determination flag UP is discriminated by the accumulator ACC, and if the contents of the flag UP is found to be "1", the process proceeds to the step ④ during which check is made as to whether or not the upper cassette C1 is empty. This empty detecting system will be described later.

If it is found that the upper cassette C1 is not empty, the step ④ is followed by the step ⑧ during which the flag UP is set to "1". At the subsequent step ⑨, the contents of the flag UP is discriminated and, at the step ⑩, a signal indicative of the supply of the copying paper from the upper cassette is generated. On the other hand, where the upper cassette C1 is found to be empty, the step ④ is followed by the step ⑤ during which check is made to find whether or not the lower cassette C2 is empty. If the lower cassette C2 is found to be empty, the "Empty" indicator is turned on during the step ⑦. However, if the lower cassette C2 is found not to be empty during the step ⑤, the process proceeds to the step ⑥ at which time a check is made as to whether or not the size of the copying papers contained in the upper cassette C1 is the same as that in the lower cassette C2. Should the size of the copying papers in the upper cassette C1 be found not to be the same as that in the lower cassette C2, the step ⑥ is followed by the step ⑦ during which the "Empty" indicator is turned on. On the other hand, if the size of the copying papers in the upper cassette C1 is found to be the same as that in the lower cassette C2, the step ⑥ is followed by the step ⑪ at which time the flag UP is set to "0". After the flag UP has been set to "0", the process proceeds from the step ⑨ to the step ⑫ during which a signal indicative of the supply of the copying paper from the lower cassette C2 is generated. Accordingly, when the upper cassette C1 is empty and the size of the copying papers in the lower cassette C2 is the same as that which have been contained in the upper cassette C1, the copying papers are automatically fed from the lower cassette C2 one at a time. A system for detecting the size of the copying paper will be described later.

In the case where the flag UP is set to "0" during the step ①, that is, where the roller R2 associated with the lower cassette in the lower supply unit is brought into operation, a similar process takes place. In other words, the step ③ is followed by the step ⑬ during which check is made as to whether or not the lower cassette C2 is empty, and then followed by the step ⑭ during which check is made as to whether or not the upper cassette C1 is empty. At step ⑮, a check is made to find whether or not the size of the copying papers in the upper cassette C1 and that in the lower cassette C2 are identical with each other, and where they are found to be identical, the step ⑮ is followed by the step ⑧ at which time the flag UP is set to "1" so that the supply of the copying papers one at a time from the upper cassette C1 can automatically be initiated.

Hereinafter, the system of detecting the size of the copying papers and the empty detecting system will be described in relation to outputs from the microcomputer MC with reference to FIGS. 1 and 23.

The upper and lower cassettes C1 and C2 are loaded in the copying machine in the manner as shown in FIG. 1. FIG. 23(*a*) illustrates an arrangement of magnets mA, mB, mC and mD selectively secured to the bottom of each of the cassettes C1 and C2 by the use of a bonding agent, so that they can cooperate with a corresponding number of reed switches (not shown) which are selectively actuated by one or more of the magnets mA to mD, when the cassette is loaded in the machine, to detect the size of the copying papers contained in such cassettes. For this purpose, for each size of the copying paper listed in the table shown in FIG. 23(*b*), one or a combination of the magnets mA to mD are secured to the bottom of the paper cassette in a manner as marked by the circles in the table of FIG. 23(*b*). By way of example, in the case of the A3-size copying papers, only the magnet mA is secured at a definite position on the bottom of the cassette containing such A3-size papers and in the case of the A6-size copying papers, all of the magnets mA to mD are secured at respective positions on the bottom of the cassette containing such A6-size copying papers. Therefore, it will readily be seen that, if one of the reed switches (not shown) located in the machine at a predetermined position corresponding to the position of, for example, the magnet mA on the bottom of the cassette is activated by the magnet mA, the size of the copying papers contained in such cassette can be detected as A3-size paper. In this way, one or a combination of the reed switches when activated by the presence of corresponding one or combination of the magnets mA to mD generate respective signals with which the microcomputer MC determines the size of the copying papers in the cassette actually loaded in the machine.

Figures 23A, 23B:
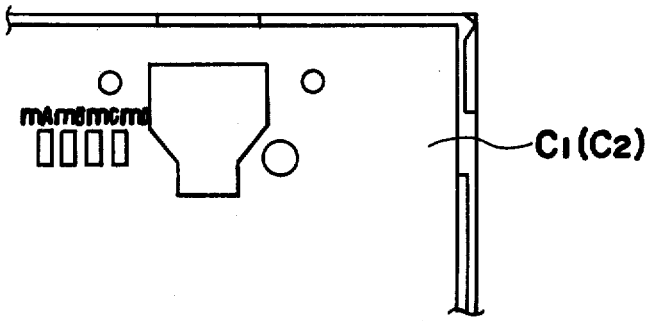
FIG. 23(*a*) is a schematic diagram showing the positions of respective magnets forming a part of a paper size detector in the machine.

As shown in FIG. 23(*a*), for enabling the detection whether or not each cassette loaded in the machine is empty, the bottom and the top covering of each cassette have respective openings defined therein for the passage of a beam of light therethrough. On the other hand, two combinations of light emitting diodes PD1 and PD2 with light sensors PC1 and PC2 are employed in the machine one for each of the upper and lower cassettes C1 and C2, respectively, as shown in FIG. 1. Specifically, the light emitting diode PD1 and the light sensor PC1 are so positioned that, when the lower cassette C1 is loaded in the machine and such lower cassette is empty, a beam of light emitted from the diode PD1 can pass through the openings in the bottom and top covering of such lower cassette C2 and be then sensed by the light sensor PC1. Similarly, the light emitting diode PD2 and the light sensor PC2 are so positioned that, when the upper cassette C1 is loaded in the machine and such upper cassette is empty, a beam of light from the diode PD2 can pass through the openings in the bottom and top covering of such upper cassette C1 and be then sensed by the light sensor PC2.

Since the control of the paper supply mechanism described above is disclosed in the U.S. Patent Application Serial No. 19,893 filed Mar. 12, 1979 by the same assignee of the present invention, the details thereof are not herein described for the sake of brevity and reference may be had thereto.

Figure 22:
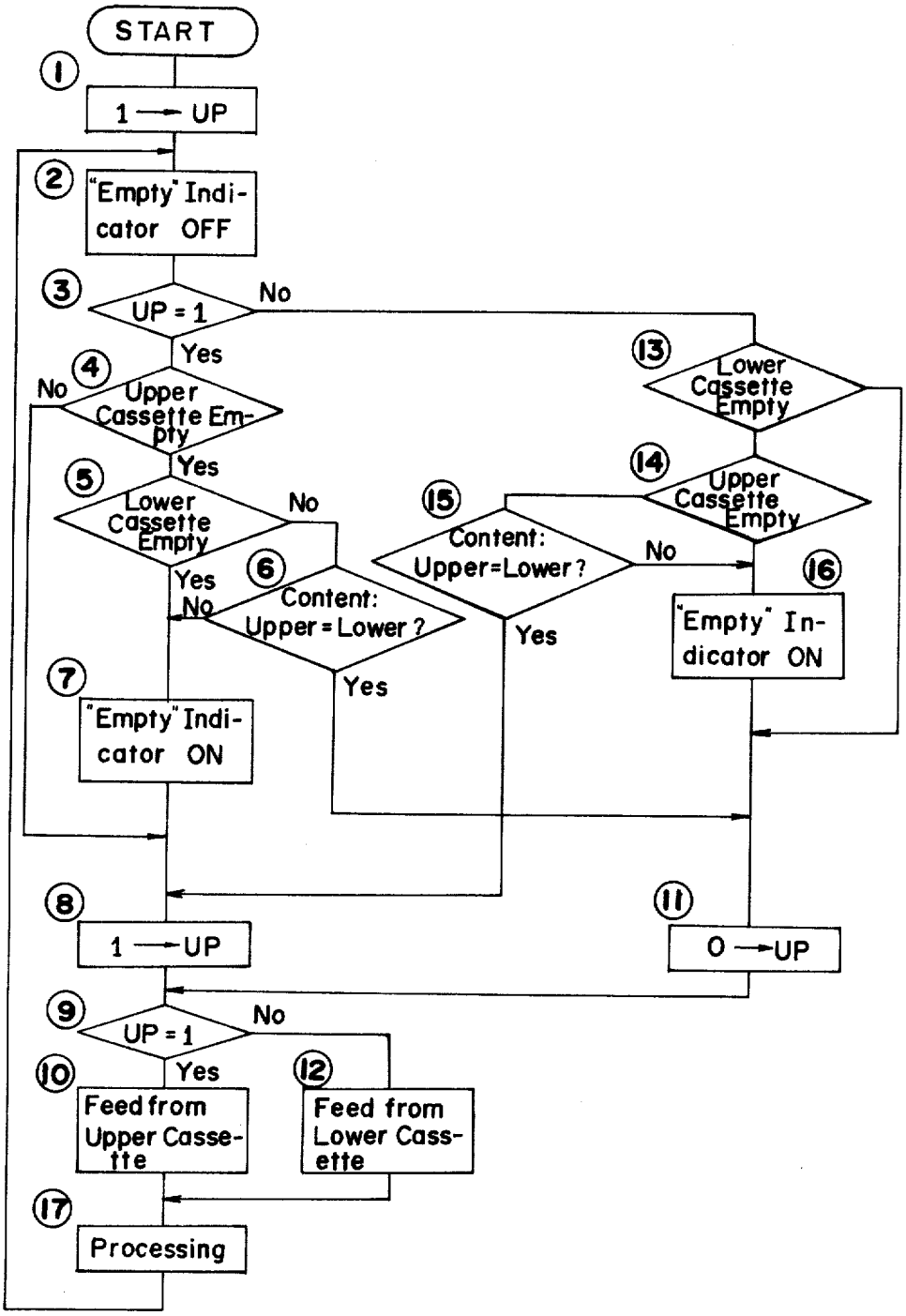
FIG. 22 is a flow chart showing the sequence of control of a paper supply unit in the machine.

As described hereinbefore, in the copying machine embodying the present invention, discrimination of the size of the copying papers in the cassette is performed by the reed switches, installed on the machine, in cooperation with the combination of the magnets mA to mD, and the control is carried out in a manner as shown in the flow chart of FIG. 22. Therefore, the paper supply can be performed effectively and efficiently. It is to be noted that, as hereinbefore described, at the time any one of the paper feed rollers R1 and R2 is driven, the time during which the solenoid SL1 is actuated is so controlled as to enable the corresponding roller R1 or R2 to rotate through the angle corresponding to 5/6 of the 360° rotation.

The signals generated from the paper size detecting system shown in FIGS. 23(*a*) and 23(*b*) are utilized not only to control the operation of the paper feed mechanism, but also to control the time during which the optical scanning system is moved and to select the sequence mode which is set variable according to the size of the copying papers used and the selected magnification. In other words, when the size of the copying papers or the magnification factor is switched over to another size or magnification factor, the various control timers must be so set that the distance and velocity of movement of the optical scanning system is moved correspondingly or the time during which any one of the electrostatic charge and exposure is effected is varied to effect an efficient copying operation with the minimized loss of time. Accordingly, the signals from the paper size detecting mechanism are utilized to determine the preset times of the respective control timers for each sequence mode. As an example in which the preset time of the timer is varied for each sequence mode, the control of the time during which the optical scanning system will now be described.

[Control of Optical Scanning System]

Figure 24:
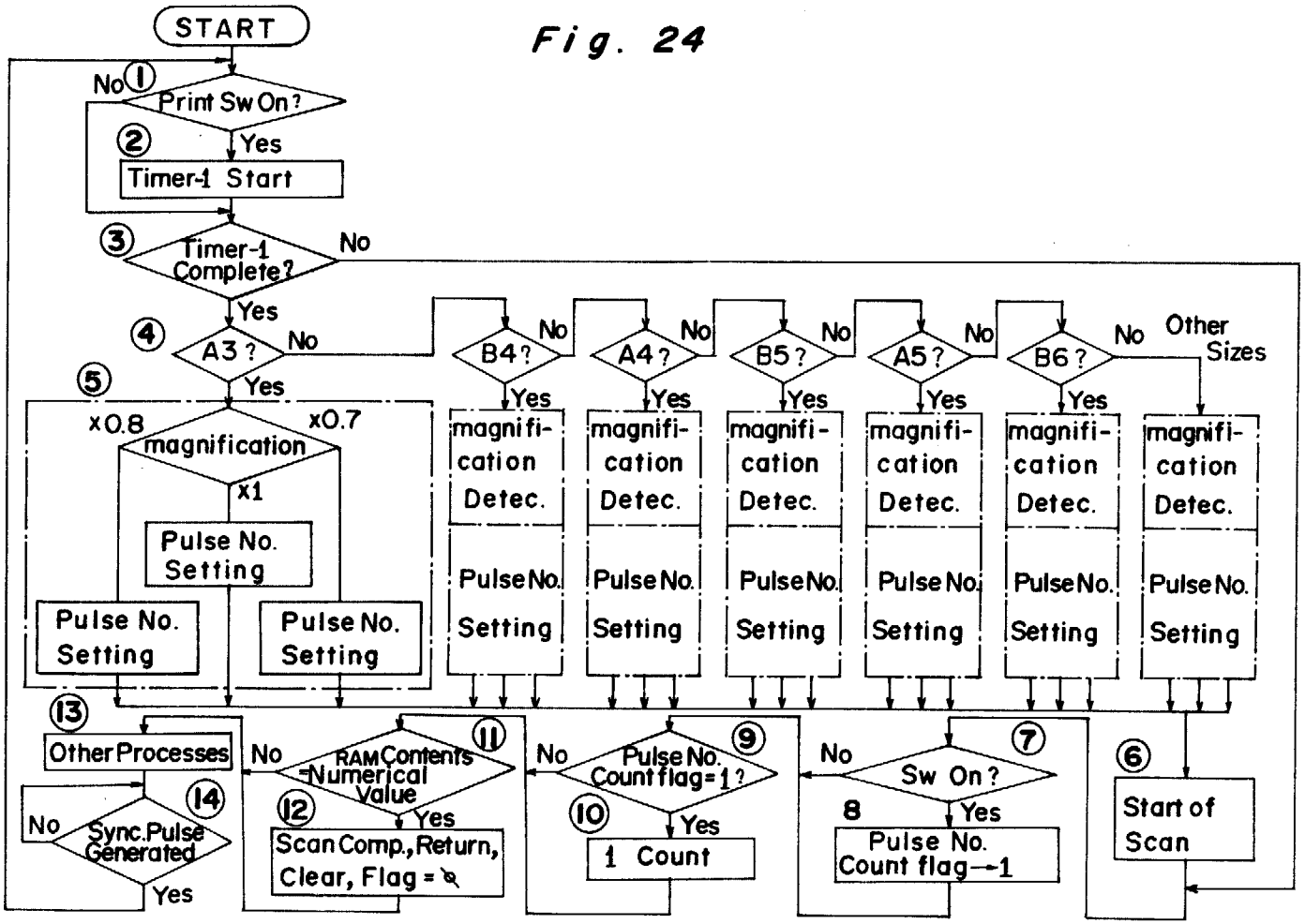
FIG. 24 is a flow chart showing the sequence of control of the optical scanning system.

A flow chart showing how the optical scanning system is controlled is shown in FIG. 24.

Referring now to FIG. 24, from the start signal section, the condition of copying operation is determined at the step ①. That is to say, at the step ①, check is made as to whether or not the "Print" switch (not shown) is turned on and if it is found to be turned on, a delay timer TIM-1 (not shown) is actuated at the subsequent step ②. This is for the purpose of securing the time necessary to cause the illuminating lamp 81 to be lit to its maximum available intensity of light before the start of operation of a drive mechanism for the optical scanning system which takes place incident to the switching-on of the "Print" switch. It is to be noted that the delay timer TIM-1 has a construction similar to any one of the counters C-A and C-B referred to hereinbefore. At the step ③ following the step ②, check is made as to whether or not the timer TIM-1 is completed, and if it is completed, the process proceeds to the step ④ during which the size of the copying papers is checked. This checking of the paper size is performed by supplying the signal from the size detecting system to the microcomputer MC through the interface I/O. At the step ⑤ following the step ③, based on the signal indicative of the magnification generated from the corresponding reed switch SW2, SW3 or SW4 shown in FIG. 11, a predetermined number of pulses is set in view of the size of the copying papers detected in the manner as hereinbefore described. This setting of the predetermined number of pulses is carried out by the utilization of numerical data set by supplying the signal indicative of the detected paper size and the signal indicative of the selected magnification to the random access memory RAM through the interface and designating the address of the program stored in the read-only memory ROM on the basis of what is determined by the contents of the random access memory RAM.

At the step ⑥, a selection signal for selecting one of the scan clutches 101, 102 and 103 (FIG. 11), which is also used to designate the copying speed, is generated in dependence on the signal indicative of the selected magnification (It is to be noted that the main motor has already been started incident to the switching-on of the "Print" switch.) and the optical scanning system starts its movement at a predetermined velocity. At the step ⑦, a check is made as to whether or not a switch is actuated at a predetermined position by the movement of the optical scanning system. This switch is, for example, the reed switch SW7 which is actuated by the magnet 115 as shown in FIG. 12. When the reed switch SW7 is found to be turned on, the process proceeds to the step ⑧ during which the pulse number count flag is set to "1". This flag is obtained by previously designating a predetermined bit in a predetermined area of the random access memory RAM.

At the step ⑨, said pulse number count flag is determined and, if it is set to "1", the step ⑨ is followed by the step 10 during which "1" is added to the contents of the counter. This counter serves to designate an area of the random access memory RAM for counting which is different from that of the random access memory RAM used at the step ⑤ and is operable to count up the contents by an increment of "1" in response to each pulse of the pulse train P2, that is, each time one routine of the program completes.

At the step ⑪, comparison is made as to whether or not the contents of the random access memory RAM for counting is equal to the predetermined numerical value preset in the program designated by the contents stored in the random access memory RAM in correspondence with the size of the copying papers and the magnification set during the step ⑤. If they are found to be equal to each other the step ⑪ is followed by the step ⑫, but skips to the step ⑬ if they are found to be not equal to each other. As a comparison means, for example, a command capable of loading the contents of the random access memory RAM for counting in the accumulator ACC and comparing the accumulator ACC and the designated contents of the random access memory RAM is utilized.

If it is found as a result of the comparison made at the step ⑪ that the counted number is equal to the preset numerical value, the process proceeds to the step ⑫ at which time a signal necessary to turn off the scan clutches is generated followed by the generation of a signal necessary to turn on the return clutch which takes place delayed a certain time from the generation of the signal for the scan clutches. (It is to be noted that other timers are set even during this delay time.) While an electric circuitry for turning on and off the clutches by the use of an arbitrary signal is well known to those skilled in the art and, therefore, the details thereof are not herein described, it is generally connected to a clutch actuating circuit from the interface I/O through any suitable switching circuit. Completion of the return movement of the optical scanning system which has started the return movement is carried out in the process during the step ⑬. (It is to be noted that, when the switch SW6 is turned on, this means that the return movement of the optical scanning system has been completed.)

During the step ⑫, not only are the signals necessary to interrupt the scanning and to initiate the return movement generated as hereinbefore described, the contents of the random access memory RAM are cleared in readiness for the next succeeding copying operation and also the pulse number count flag is reset to "0".

After a train of synchronizing pulses P3 necessary to adjust the pulse interval of each pulse of the pulse train P2 has been generated at the step ⑭, the process returns back to the initial step ①.

In the foregoing description, one routine of operation of the microcomputer MC which takes place during the duration of each pulse of the pulse train P2 has been described. However, in view of the fact that the scanning of, for example, the A-3 size or A-5 size originals at an equal magnification requires 2 seconds or 1 second, respectively, assuming that the designed value of the pulse interval of the above described synchronizing pulse is 10 msec., the preset number in the program will read 200 or 100 in the case where it has been found during the step ④ that the A-3 size or A-5 size copying paper is used, respectively. In such case, subsequent to the start of the scanning, and after the above described operation has been repeated 200 or 100 times, respectively, subsequent to the switching-on of the switch SW7, the determination of "YES" is carried out at the step ⑪, thereby interrupting the movement of the optical scanning system. Although the speed of movement of the optical scanning system may vary with variation of the speed of the motor of the drive system, the difference therebetween can be compensated for because the synchronizing pulse P3 can also vary with variation of the speed of the motor, and, therefore, the preset number need not be changed. It is to be noted that it is possible to design or prepare a signal necessary to turn off the scanning movement by continuously operating two or more timers subsequent to the switching-on of the switch SW7.

Where the magnification factor is selected to be of a value other than an equal magnification factor and so is detected, the preset number at the step ⑤ varies correspondingly because the number corresponding to the time required for the optical scanning system movable at a speed determined in dependence on the selected magnification factor to travel a distance corresponding to the area to be copied has been predetermined beforehand and set. Even where a combination of the magnification factor and the size of the copying paper is selected in such a manner as to require the optical scanning system to travel a distance larger than the available length of the support 80 (FIGS. 1 and 10), care is required so as to avoid any possible setting of the number required for the optical scanning system to travel such a large distance.

This type of control of the time required for the optical scanning system to undergo its scanning movement requires the setting of a complicated combination of times, as compared with those occasions wherein the return position is determined to cope only with the size of the original to be copied, because the speed of the scanning movement must be adjusted each time the magnification factor is changed. In view of this, the employment of a construction wherein the setting times of the timers are made variable according to the program by the use of the microcomputer, such as achieved by the present invention, is advantageous.

Although in the flow chart of FIG. 24, the copying machine embodying the present invention has been shown, for the sake of brevity, as having a capability of reproducing the image on the copying papers of six different paper sizes, one at a time in contrast to the nine sizes shown in FIG. 23(*b*) as available, the machine embodying the present invention is to be understood as having a capability of reproducing the image on the copying papers of the sizes specified in FIG. 23(*b*) one at a time. In addition, in an actual sequence control, an arrangement of the timers will be more complicated than that described for the purpose of illustration of the present invention, because the timing controls of the electrostatic charge, the exposure and other operations than the control of movement of the optical scanning system are also paralleled. Hereinafter, an specific example of sequence control will be described.

[Sequence Control]

As hereinbefore described, the copying machine embodying the present invention has a capability of reproducing the image at a plurality of magnifications and also a capability of reproducing the image on copying papers of different sizes and, therefore, has a plurality of sequence modes one for each selected combination of the paper sizes and the magnifications.

Where different sequence control programs are employed and set one for each sequence mode, the copying machine would not work efficiently. Accordingly, in the present invention, the sequence control for the copying operation is carried out by selecting a suitable combination of a first group of timers TA common to all of the sequence modes with a second group of timers TB of which the setting are determined by a combination of the signals indicative of the magnification detected (i.e., those generated from the respective reed switches SW2 to SW4 as shown in FIG. 11) with the signals indicative of the particular size of the copying papers (i.e., those generated from the respective reed switches operatively associated with the magnets mA to mD). Some specific examples of the sequence control for the copying operation will now be described with particular to FIGS. 25 to 27 in combination with FIG. 1.

Two Repetitive Reproduction on A-5 size Paper at ×1 Magnification

Figure 25:
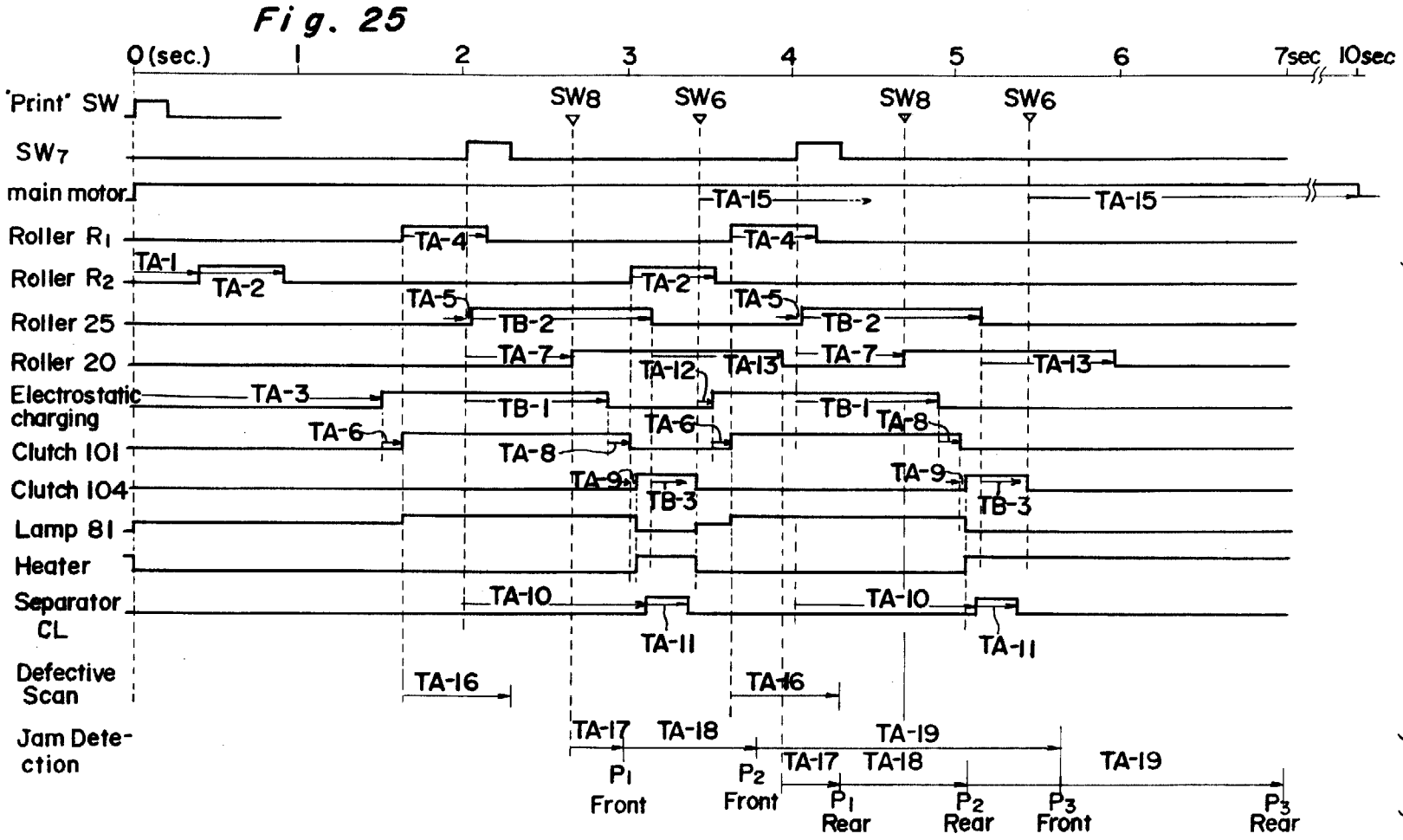
FIGS. 25, 26 and 27 are timing charts, respectively, showing three different sequence control modes.

The sequence control mode for this purpose is shown in a timer chart shown in FIG. 25.

Referring to FIG. 25, when the "Print" switch is turned on after the electric power has been supplied to the machine and the fixing device 14 has subsequently been heated to a predetermined temperature, the main motor (not shown) is driven to transmit its drive force to the photoreceptor drum 1 and also the other movable parts through the chains and the timing belts.

Incident to the switching-on of the "Print" switch, the timers TA-1 and TA-3 of the timer group TA are set. The timer TA-1 serves to actuate the paper feed roller R2 when the lower cassette C2 is selected to be brought into operation whereas the timer TA-3 serves to switch on the electrostatic charger 2 upon the lapse of the preset time thereof. The timer TA-6 is set in response to the lapse of the preset time of the timer TA-3 to switch on the clutch 101 for the optical scanning system to initiate the scanning movement of the optical scanning system and, at the same time, the timer TA-4 for operating the roller R1 starts its operation. After the lapse of the preset time of the timer TA-1, not only is the timer TA-2 operated, but also the solenoid unit for the clutch associated with the paper feed roller R2 is switched on (See FIGS. 4 and 5) for a predetermined time as hereinbefore described, thereby permitting the paper feed roller R2 to be brought to a halt upon completion of its rotation through the angle corresponding to 5/6 of one complete rotation. The copying paper fed by the paper feed roller R2 is temporarily brought to a halt by the intermediate roller 25. When the copying paper is fed from the upper cassette C1, it will not be brought to a halt by the roller 25, but by the timing roller 20. As the optical scanning system moves, the reed switch SW7 shown in FIG. 12 is switched on by the magnet 115 when the optical scanning system passes the predetermined position to set the timers TA-5, TA-7 and TB-1. The timer TA-5 is operable to drive the intermediate roller 25 upon the lapse of the preset time thereof to feed the copying paper, which would be temporarily blocked thereby, towards the processing station. Although the timer TA-7 is operable to drive the timing roller 20 upon the lapse of the preset time thereof, the timing roller 20 is driven directly in response to the switching-on of the timing switch SW8 actuated by the optical scanning system, and the timer is used to bring the timing roller 20 to a halt upon the lapse of the preset time of the timer TA-13 as will be described later.

The timer TB-1 belongs to the second timer group TB, the preset time of which varies according to the size of the copying paper and the magnification selected. That is to say, as is the case with the timers TB-2 and TB-3 described later, with respect to the control object whose operating time is required to be changed in dependence on change in size of the copying paper and magnification, the preset time of each of the timers of the second timer group TB is made variable by suitably and selectively setting the numerical data. This data has been set in the program, according to the external signals so that, upon the lapse of the preset time of the particular timer of the second timer group TB or by continuously setting the predetermined first timer group TA to the second timer group TB, the operation thereof can be switched off.

The timer TB-1 is set during the timing of the switching-off of the electrostatic charger. The timer TB-2 is set upon the lapse of the preset time of the timer TA-5 and is kept in the set state during the timing of the switching-off of the drive of the intermediate roller 25. The timer TA-8 for switching off the clutch 101 and the timer TA-9 for switching on the return clutch 104, both belonging to the first timer group and being common to all of the sequence modes, are set at a reference time coinciding with the time at which the preset time of the timer TB-1 of the second timer group TB and, therefore, the timing at which the scanning completes and the return movement is initiated is variable substantially in dependence on the paper size and the copying magnification.

This equally applies to the operation of the timer TA-13 which is set upon the lapse of the preset time of the timer TB-2 and, accordingly, the timing at which the timing roller 20 is switched off is also variable.

The third timer TB-3 of the second timer group TB is adapted to be set upon the lapse of the preset time of the timer TB-2, the preset time of which is so selected as to lapse somewhat earlier than the timing at which the optical scanning system returns to the original position, the timing at which the read switch SW6 is turned on. Then, after the switching-on of the reed switch SW6, the timer TA-12 for switching on the electrostatic charger in readiness for the reproduction of the image on the next succeeding copying paper is actuated followed by the timer TA-6 which is actuated upon the lapse of the preset time of the timer TA-12 to switch on the scan clutch.

During a repetitive copying operation to produce two copies according to this sequence mode, the supply of the next succeeding copying paper is, as is the case of the previous supply of the first copying paper from the upper cassette by the action of the paper feed roller R1, initiated by the action of the paper feed roller R2 during the timing at which the scan clutch 101 is switched off that is, upon the lapse of the preset time of the timer TA-8 and also during the timing at which the scan clutch 101 is switched on, that is, upon the lapse of the preset time of the timer TA-6.

In this sequence mode, although the timer TB-3 does not work substantially, this timer TB-3 is treated as a conditional signal for initiating the copying operation for the reproduction of the same image on the second and succeeding copying papers. That is, in the sequence mode which will be described later, the time at which the preset time of the timer TB-3 elapses is set to be later than the timing at which the optical scanning system returns to the original position so that, upon the lapse of the preset time of the timer TB-3. The timer TA-12 for switching on the electrostatic charger and the timer TA-6 for switching on the scanning movement can be actuated, whereby the electrostatic charging and other operations for the next succeeding copying operation can be initiated by the AND logic of two conditional signals which are respectively generated upon the lapse of the preset time of the timer TB-3 and the switching-on of the switch SW6. In other words, at the timing either at which the preset time of the timer TB-3 has passed or at which the optical scanning system returns to the original position, whichever occurs later, the copying operation to produce the second and succeeding copies is initiated.

As hereinbefore described, during the repetitive copying operation to produce a plurality of copies in succession, in order to switch on the electrostatic charger, the scanning and others for the copying operation to produce the second and succeeding copies, it is at least essential that the optical scanning system be returned to the original position. In addition thereto, depending on the combination of the paper size and the magnification used (The length of the passage through which the copying paper travels is also one of factors influential on this combination, too.), there are various conditions to be satisfied in order for the second and succeeding cycles of copying operation to be initiated and the time required for these conditions to be satisfied varies according to the sequence mode. Therefore, the timer TB-3 has a preset time determined on the basis of the copying initiating conditions for each sequence mode and generates the conditional signal, the sequence mode of FIG. 25 being an example wherein those conditions are satisfied before the optical scanning system completes its return movement to the original position.

The illuminating lamp 81 is preliminarily energized by the switching-on of the "Print" switch and is then energized to emit the maximum available light upon the lapse of the preset time of the timer TA-6. However, during the next succeeding cycle of copying operation to produce the second copy, the lamp 81 is preliminarily energized upon return of the optical scanning system to the original position and energized to emit the maximum available light upon the lapse of the preset time of the timer TA-6. The heater incorporated in the fixing device is electrically energized only during the deenergization of the illuminating lamp 81, thereby minimizing any possible excessive consumption of the electric power consumed on a whole by the copying machine. A separator clutch CL is a clutch for actuating the charge cam wheel 71 in the paper separating mechanism as described with reference to and shown in FIGS. 8 and 9 and, when this clutch is coupled, the cam wheel 71 is rotated to cause the nozzle assembly 8 to produce the jets of air in the manner as hereinbefore.

In the timer chart for the sequence control described above, since the mechanical operation and the control signals from the microcomputer MC need not be synchronized with each other, the timers TA-1, TA-2, TA-3, TA-4 and TA-6 may be timers which do not utilize the pulse train P3 generated by such a mechanical pulse generator PG3 as shown in FIG. 18, but which are operable with internal reference pulses PG2 generated inside the microcomputer MC as shown in FIG. 16. Particularly, the use of the internal timers for the timers TA-1 and TA-3 is preferred because the motor requires a certain time subsequent to the switching-on thereof until the rotation thereof is stabilized. Moreover, since the scan movement and the transportation of the copying paper must be synchronized exactly with each other subsequent to the switching-on of the reed switch SW7 actuated by the optical scanning system, the timers TA-5, TA-7, TB-1 and so on are operable with the pulse train P3 generated from the pulse generator PG3.

In FIG. 25, timers for detecting the occurrence of paper jamming and for detecting the failure of the scanning are also shown.

The timer TA-16 is set in response to the switching-on of the scan clutch, that is, upon the lapse of the preset time of the timer TA-6 and is operable to determine, and generate a detection signal indicative of, the failure of the scanner 82 to move, when the reed switch SW7 is not actuated during the preset time of the timer TA-16.

The timers TA-17, TA-18 and TA-19 are operable to detect whether or not the copying paper, the transportation of which is initiated at the time the timing switch SW8 is turned on, that is, at the time the timing roller is switched on, has arrived at or passed through check points P1, P2 and P3 shown in FIG. 1, respectively. The timers TA-17, TA-18 and TA-19 are provided in two series systems which have their starting points of operation respectively at the time of the switching-on of the timing roller and the switching-off of the timing roller (upon the lapse of the preset time of the timer TA-13). The timers of the system having the starting point coinciding with the switching-on of the timing roller are used to determine whether or not the copying paper being transported has arrived at the respective check points P1, P2 and P3 within predetermined times. That is, should the copying paper being transported fail to arrive at the check points P1, P2 and P3 by the respective times the preset times of the timers TA-17, TA-18 and TA-19 have passed, they generate jam signals indicative of the occurrence of the paper jamming. On the other hand, the timers of the system having the starting point coinciding with the switching-off of the timing roller, the reference of which is synchronized with the trailing or rear end of the copying paper with respect to the direction of transportation thereof, generate jam signals indicative of the occurrence of the paper jamming when the copying paper is present at the check points P1, P2 and P3 at the time of the lapse of the preset timer thereof, respectively. A method and a structure for detecting the occurrence of the paper jamming in the manner described above is are disclosed in the U.S. patent application Ser. No. 28,322 filed Apr. 9, 1979 by the same assignee of the present invention and, therefore, the details thereof are not herein recited for the sake of brevity.

For detecting the copying paper at each of the check points P1, P2 and P3, an ultrasonic sensor is employed although either a microswitch or a photosensor may be employed instead of the ultrasonic sensor. However, the use of the ultrasonic sensor at each of the check points P1, P2 and P3 is advantageous because it has no projecting element or actuator such as required in the microswitch and also it can be used with a transparent film as a copying paper.

It has been described that the next succeeding cycles of copying operation to produce the second and succeeding copies are initiated at the timing either at which the preset time of the condition timer TB-3 has passed or at which the optical scanning system has returned to the original position, whichever occurs later. However, when and after the last copy has been produced, an autoshut timer TA-15 is actuated by this timing signal to enable the main motor to be brought to a halt a predetermined time after the completion of the repetative copying operation for producing the copies in succession.

Two Repetitive Reproduction on A-4 size Paper at ×1.4 Magnification

Figure 26:
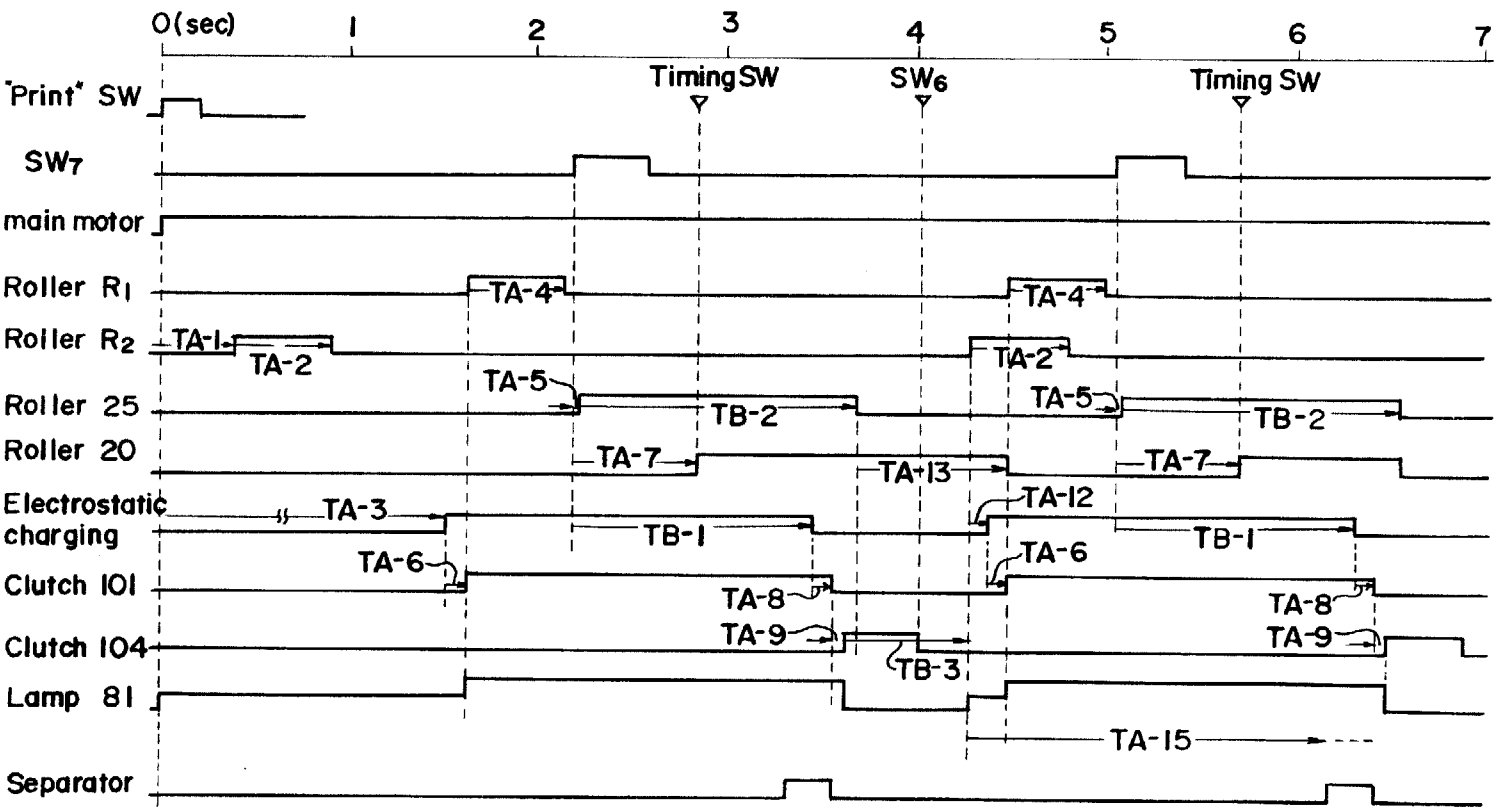

A timer chart for the sequence control mode for this purpose is shown in FIG. 26. (It is to be noted that this is an example wherein the copying machine of the present invention can produce a copy at a maximum available magnification.)

As can be understood from FIG. 26, the difference between the sequence modes shown respectively in FIGS. 25 and 26 resides in the timers TB-1, TB-2 and TB-3 of the second timer group TB while the preset time characteristics and functions of the timers of the first timer group remain the same. Specifically, the preset times of the respective timers of the second timer group TB are varied to cope with the selected paper size and the selected magnification so that they can work in harmony with the timers of the first timer group TA to achieve a systematized sequence control.

In the sequence mode shown in FIG. 26, the preset time of the timer TB-3 takes place subsequent to the return of the optical scanning system to the original position and, accordingly, the timer TA-12 for initiating the electrostatic charging is actuated upon the lapse of the preset time of the timer TB-3, followed by the actuation of the timer TA-6 for initiating the scanning of the optical scanning system.

As regards the auto-shut timer TA-15, it is set upon the lapse of the preset timer TB-3.

Although the capability of reproducing the image at ×1.4 magnification has not hereinbefore referred to, it is to be noted that, during this capability, the scanning speed is lower than that during the capability of reproducing the image at equal (×1.0) magnification and, accordingly, the timing switch would be on one side of the reed switch SW8 adjacent the reed switch SW6.

Two Repetitive Reproduction on A-3 size Paper at ×0.647 Magnification

Figure 27:
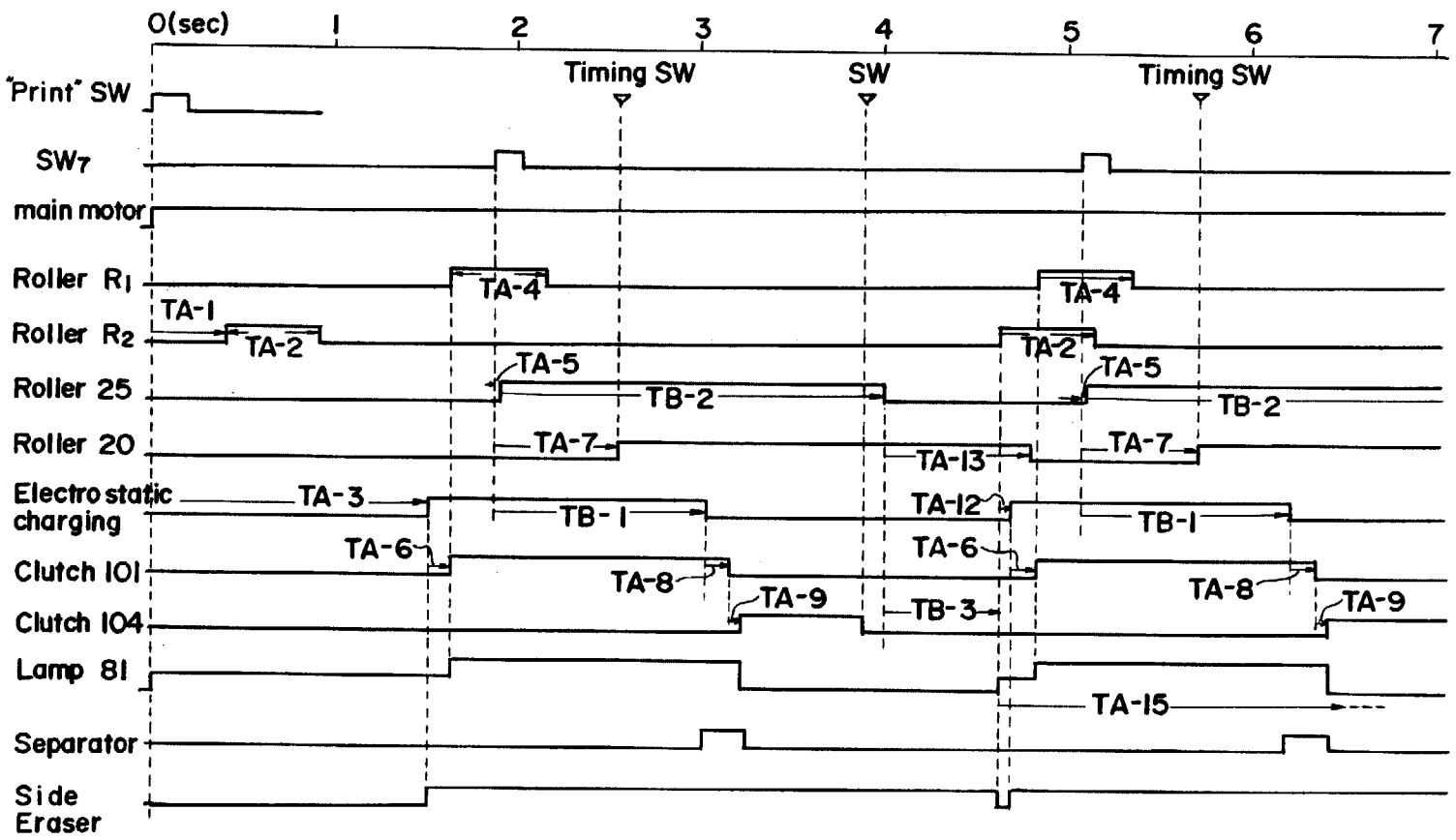

A timer chart for the sequence control mode for this purpose is shown in FIG. 27. (It is to be noted that this is an example wherein the copying machine of the present invention can produce a copy on a minimum available magnification.)

As can be understood from FIG. 27, even in this sequence mode, the preset times of the timers of the first timer group TA remain the same while those of the second timer group TB are varied. In addition, in view of the fact that the A-3 size copying paper is a maximum possible size that the copying machine can accept and that the scanning speed is also the highest possible speed due to the minimum available magnification, the preset time of the condition timer TB-3 terminates later than the completion of return of the optical scanning system to the original position. The timing switch used during this sequence control is located at a position displaced towards the scanning direction relative to the position where the timing switch is located when the magnification is ×0.7. It is to be noted that the magnification of ×0.647 is the one used when the copying paper, the dimensions of which are measured according to the footage system, is used.

It is also to be noted that, during the reproduced copying operation now under discussion, the side eraser 4 is lit. Since the width of the image projected onto the drum 1 during the reduced copying operation is smaller than the effective width of the photoreceptor drum 1, the side eraser 4 serves, when lit, to dissipate some of the electrostatic charge on the photoreceptor drum 1 which are present on the end portions of the drum 1. The portion of the electrostatical charge on the drum 1 which is to be erased by the side eraser can be selectively controlled according to the magnification selected.

Although the present invention has fully been described in connection with the preferred embodiment thereof with reference to the accompanying drawings, it is to be noted that various changes and modifications are apparent to those skilled in the art. Such changes and modifications are to be understood as included within the true scope of the present invention unless they depart therefrom.

We claim:

1. In an electrophotographic copying machine of transfer type which comprises an electrophotographic member supported for movement, a support for the support of an original to be copied thereon, a scanning means supported for reciprocal movement between start and scanned positions relative to the original support to scan the original on the support, means for designating one of a plurality of image forming conditions for determining a particular mode of operation, means for driving the scanning means, means for detecting that the scanning means is held at the start position, means for transporting a copying medium, and control means operatively correlated with at least said scanning means, said designating means, said driving means, said detecting means and said transporting means for generating a control signal during the mode of operation based on the image forming condition designated by the designating means, the improvement which comprises a first group of timers utilizable in common to all of the modes irrespective of said particular mode of operation, means for determining the particular mode of operation on the basis of an output signal generated from the designating means, a second group of timers having their preset times determined in correspondence to the mode of operation determined by the determining means, and a processing means for generating, in response to the lapse of the preset time of each timer of the first and second groups, a control signal necessary to control said scanning means, said driving means and said transferring means and also for performing a process incident to completion for one copying operation when both of the condition in which the preset time of one particular timer of the second group has been passed and the condition in which the detecting means has detected the complete return of the scanning means to the start position after having been moved to the scanned position are fulfilled.

2. A machine as claimed in claim 1, wherein said designating means includes means for selecting the size of copying papers.

3. A machine as claimed in claim 1, wherein said designating means includes means for selecting the magnification on which the image of the original is reproduced on a copying paper.

4. A machine as claimed in claim 2, wherein at least one of the timers of the second group is operatively associated with the timing of completion of the scanning of the scanning means.

5. A machine as claimed in claim 3, wherein said control means is operable to vary the driving speed of said driving means in correspondence with at least the selected magnification.

6. A machine as claimed in claim 1, wherein said control means is further operatively associated with means for electrostatically charging the electrophotographic member and a lamp means for illuminating the original, said first group of the timers being operatively associated with said charging means and said lamp means for controlling the initiation of operation of said charging means and said lamp means, said second group of the timers being operatively associated with said charging means and said lamp means for controlling the deenergization of said charging means and said lamp means.

7. A machine as claimed in claim 6, wherein said designating means includes means for generating a size signal indicative of the selected size of the copying papers, said control means being operable to determine the preset times of the timers of the second group according to the size.

8. A machine as claimed in claim 6, wherein said designating means includes means for generating a magnification signal indicative of the selected magnification, said control means being operable to determine the preset times of the timers of the second group according to the magnification signal.

9. A machine as claimed in claim 9, wherein said control means is constituted by a microcomputer, preset times of the timers of each of the first and second groups being stored in a memory of the microcomputer in the form of numerical data, said preset times of the timers of the second group being selected from the numerical data according to the determination of the mode of operation.

10. A machine as claimed in claim 1, wherein said processing means causes, when said two conditions are fulfilled, one of the timers of the first group to start for stopping the drive system of the machine after a predetermined time.

11. A machine as claimed in claim 10, wherein said control means is further operatively associated with means for presetting the number of the copying papers, said processing means when said two conditions are fulfilled and also when the copying operation to produce copies in a number preset by said presetting means has not yet completed causing a predetermined timer of the first group to start in readiness for the next succeeding copying operation and also cancelling substantially the operation of the timer for stopping the drive system.

12. A machine as claimed in claim 1 or 7, wherein said transporting means includes a timing roller effective to bring a copying paper being transported to a temporary halt and transport it again in synchronism with the movement of the copying paper, a predetermined timer of the second group being associated with the timing of interruption of the drive of the timing roller.

13. A machine as claimed in claim 12, wherein said scanning means includes an actuator for actuating a switch during the movement of the scanning means, said timing roller being operatively associated with said switch such that, when said switch is actuated, said timing roller is driven.

14. A machine as claimed in claim 1, further comprising a paper detecting means for detecting the absence or presence of a copying paper on a path of movement of the copying paper, said control means generating a jam signal when the copying paper is not detected thereby at the time of lapse of the preset time of a predetermined timer of the first group.

15. A machine as claimed in claim 14, wherein a predetermined timer of the first group is operatively associated with a predetermined timer of the second group, said control means generating a jam signal when said paper detecting means detects the presence of the copying paper at the time the preset times of said predetermined timers of the respective first and second groups have elapsed.

16. In an electrophotographic copying machine of a transfer type which comprises an electrophotographic member supported for movement, a support for the support of an original to be copied thereon, means for forming an image on the electrophotographic member in correspondence to the image of the original, means for designating one of a plurality of image forming conditions, and control means operatively associated with the image forming means and the designating means for generating a control signal during a mode of operation based on the image forming condition designated by said designating means, the improvement which comprises a first group of timers utilizable in common to all of modes of operation, means for determining the particular mode of operation on the basis of an output signal generated from the designating means, a second group of timers having their preset times determined in correspondence to the mode of operation determined by the determining means, and a processing means for starting the timers of the first and second groups in a predetermined order for generating a control signal necessary to control the operation of the image forming means incident to the lapse of the preset timers of the times of the first and second groups.

17. A machine as claimed in claim 16, wherein said control means is further operatively associated with means for electrostatically charging the electrophotographic member and a lamp means for illuminating the original, said first group of timers being operatively associated with said charging means and said lamp means for controlling the initiation of operation of said charging means and said lamp means, said second group of the timers being operatively associated with said charging means and said lamp means for controlling the deenergization of said charging means and said lamp means.

18. A machine as claimed in claim 17, wherein said designating means includes means for generating a size signal indicative of the selected size of the copying papers, said control means being operable to determine the preset times of the timers of the second group according to the size.

19. A machine as claimed in claim 17, wherein said designating means includes means for generating a magnification signal indicative of the selected magnification, said control means being operable to determine the preset times of the timers of the second group according to the magnification signal.

20. A machine as claimed in claim 16, wherein said control means is constituted by a microcomputer, preset times of the timers of each of the first and second groups being stored in a memory of the microcomputer in the form of numerical data, said preset times of the timers of the second group being selected from the numerical data according to the determination of the mode of operation.

21. A machine as claimed in claim 16, further comprising a scanning means supported for reciprocal movement between start and scanned positions relative to the support to scan the original on the support and a position detector for detecting the positioning of the scanning means at the start position, said processing means, when both a condition in which the preset time of the last timer of the second group which exhausts its preset time the last time among the other timers of the second group is elapsed during each cycle of copying operation and a condition in which the position detector detects the return of the scanning means to the start position after having been moved to the scanned position are fulfilled, being operable to deal with a process to be performed incident to the completion of the cycle of copying operation.

22. A machine as claimed in claim 21, wherein said processing means causes, when said two conditions are fulfilled, one of the timers of the first group to start for stopping the drive system of the machine after a predetermined time.

23. An improved electrophotographic copying machine of the type that scans an original document for reproducing an image of original indicia on copying paper that can be set at various magnifications and for different size copying paper with the assistance of a microcomputer, including a photosensitive medium for producing an image of the original, means for driving the photosensitive medium, means for feeding copying paper, and means for transferring the image onto the copying paper, comprising:

a control apparatus for selecting a particular operative mode to provide a preselected number of copies at a particular magnification ratio of the original indicia on a particular size of copy paper and producing a characteristic signal of that operative mode;

means for providing a first group of time periods corresponding to particular operative features of the copying machine regardless of the preselected operative mode;

means for generating a second group of time periods corresponding specifically to each one of the possible preselected operative modes;

means for activating each of the first group of time periods during an appropriate operative cycle of the machine relative to an initialization of a copying cycle;

means for enabling the microcomputer to activate from the generating means appropriate time periods of the second group corresponding to the characteristic signal from the control apparatus, and means for implementing the scanning and reproduction cycle in response to the activated time periods of the first and second time groups.

24. The invention of claim 23 further including means for generating a pulse train synchronous with the driving of the photosensitive medium and means for varying the duration of the time periods of the first and second time groups in response to the pulse train.

25. The invention of claim 23 wherein a time period from the second group of time periods controls the means for feeding copying paper.

26. The invention of claim 23 wherein a time period from the second group of time periods controls the scan rate.

27. The invention of claim 23 further including charging means for electrostatically charging the photosensitive medium and a light source for illuminating the original document, the first group of time periods operatively controlling the initiation of the charging means and the light source and the second group of time periods controlling the de-energization of the charging means and light source.

28. A method of operating an electrophotographic copying machine of the type that scans an original document for reproducing images of the original on copying paper that can be set at various operative modes for various magnifications and different size copying paper with the assistance of a microcomputer, comprising:

selecting a particular operative mode to provide a preselected number of copies at a particular magnification ratio to the original and on a particular size of copy paper;

providing the microcomputer with a data base for the copying machine including various time periods, a first group of time periods correspondingly to particular operative features of the machine regardless of the preselected operative mode and a second group of time periods corresponding to only certain preselected operative modes;

starting the time periods associated with the first group at appropriate operative cycles of the functioning of the machine relative to an initialization of a copying cycle;

selecting appropriate time periods from the second group of time periods stored in the data base in response to the particular preselected operative mode, and controlling the scanning and reproduction cycle in response to the activated time periods of the first and second time groups.

* * * * *